US008571179B2

(12) United States Patent
Beland

(10) Patent No.: US 8,571,179 B2
(45) Date of Patent: Oct. 29, 2013

(54) COMPUTED TOMOGRAPHY SYSTEMS

(76) Inventor: Robert Beland, St. Marthe sur le Lac (CA)

( * ) Notice: Subject to any disclaimer, the term of this patent is extended or adjusted under 35 U.S.C. 154(b) by 0 days.

(21) Appl. No.: 12/459,567

(22) Filed: Jul. 2, 2009

(65) Prior Publication Data

US 2011/0002446 A1 Jan. 6, 2011

Related U.S. Application Data

(60) Continuation-in-part of application No. 12/154,013, filed on May 18, 2008, which is a division of application No. 11/283,058, filed on Nov. 18, 2005, now Pat. No. 7,375,993, which is a continuation of application No. 10/801,079, filed on Mar. 15, 2004, now Pat. No. 6,967,559, which is a continuation of application No. 09/711,789, filed on Nov. 13, 2000, now Pat. No. 6,738,275.

(60) Provisional application No. 60/164,541, filed on Nov. 10, 1999.

(51) Int. Cl.
*H05G 1/10* (2006.01)

(52) U.S. Cl.
USPC ..... 378/101; 378/4; 378/15; 378/197

(58) Field of Classification Search
USPC ..... 378/4, 15, 101, 197
See application file for complete search history.

(56) References Cited

U.S. PATENT DOCUMENTS 3,708,739 A 1/1973 Kohler ..... 363/57
4,614,999 A 9/1986 Ondera et al. ..... 363/28
4,626,983 A 12/1986 Harada et al. ..... 363/132
4,659,973 A 4/1987 Stich ..... 318/718
4,695,933 A 9/1987 Nguyen et al. ..... 363/17
4,797,801 A 1/1989 Furuhashi ..... 363/43
4,802,079 A 1/1989 Mizoguchi ..... 363/71
4,912,735 A * 3/1990 Beer ..... 378/15
4,967,333 A 10/1990 Callier et al. ..... 363/17

(Continued)

FOREIGN PATENT DOCUMENTS

EP 1164689 12/2001
JP 59 117470 7/1984

(Continued)

OTHER PUBLICATIONS

Patent Abstracts of Japan vol. 008, No. 239 (E-276), Nov. 2, 1984 & JP 59 117470 A (Toshiba Corp.), Jul. 6, 1984.

(Continued)

*Primary Examiner* — Thomas R Artman
(74) *Attorney, Agent, or Firm* — Ivan David Zitkovsky

(57) ABSTRACT

A power delivery system for computed tomography includes at least one transformer (e.g., an isolation transformer, a coupling transformer, an adaptation transformer), a rotary transformer, and at least two power inverters. The rotary transformer includes a stationary winding disposed on a stationary side and a rotational winding disposed on a rotating side. The isolation or adaptation transformer is coupled to the stationary winding or the rotating winding of the rotary transformer. At least two power inverters are constructed and arranged to provide power to the primary winding of the rotary transformer. The high-voltage unit is disposed on the rotating side and connected to receive power from the rotational winding and constructed to provide power to an X-ray source.

25 Claims, 29 Drawing Sheets

(56) References Cited

U.S. PATENT DOCUMENTS

| | | | | | |
|---|---|---|---|---|---|
| 5,008,912 | A | | 4/1991 | Farrall et al. | 378/91 |
| 5,023,769 | A | | 6/1991 | Beland | 363/86 |
| 5,056,125 | A | | 10/1991 | Beland | 378/101 |
| 5,121,314 | A | | 6/1992 | Cathell et al. | 363/17 |
| 5,241,260 | A | | 8/1993 | Beland | 323/270 |
| 5,388,139 | A | | 2/1995 | Beland | 378/112 |
| 5,391,977 | A | * | 2/1995 | Beland | 323/268 |
| 5,418,707 | A | | 5/1995 | Shimer et al. | 363/65 |
| 5,495,165 | A | | 2/1996 | Beland | 323/270 |
| 5,559,686 | A | | 9/1996 | Patel et al. | 363/43 |
| 5,566,443 | A | | 10/1996 | Allan et al. | 29/605 |
| 5,602,897 | A | * | 2/1997 | Kociecki et al. | 378/101 |
| 5,608,771 | A | * | 3/1997 | Steigerwald et al. | 378/15 |
| 5,661,774 | A | | 8/1997 | Gordon et al. | 378/101 |
| 5,806,319 | A | | 9/1998 | Wary et al. | 62/55.5 |
| 5,814,938 | A | | 9/1998 | Beland et al. | 315/3 |
| 5,966,425 | A | | 10/1999 | Beland | 378/108 |
| 6,023,153 | A | | 2/2000 | Fink | 323/210 |
| 6,111,732 | A | | 8/2000 | Beland | 361/42 |
| 6,118,227 | A | | 9/2000 | Beland | 315/276 |
| 6,121,692 | A | | 9/2000 | Michaels et al. | 307/10.1 |
| 6,133,741 | A | | 10/2000 | Mattes et al. | 324/502 |
| 6,144,170 | A | | 11/2000 | Beland et al. | 315/276 |
| 6,424,098 | B1 | | 7/2002 | Beland et al. | 315/224 |
| 6,476,993 | B1 | | 11/2002 | Aoki | 360/64 |
| 6,674,836 | B2 | | 1/2004 | Harada et al. | 387/107 |
| 6,738,275 | B1 | | 5/2004 | Beland | 363/71 |
| 6,967,559 | B2 | | 11/2005 | Beland | 336/219 |
| 7,054,411 | B2 | * | 5/2006 | Katcha et al. | 378/101 |
| 7,375,993 | B2 | | 5/2008 | Beland | 363/71 |
| 7,936,544 | B2 | * | 5/2011 | Beland | 361/58 |
| 2003/0091118 | A1 | | 5/2003 | Lohr | 375/258 |
| 2010/0066340 | A1 | * | 3/2010 | Delforge | 323/305 |
| 2011/0002446 | A1 | * | 1/2011 | Beland | 378/111 |

FOREIGN PATENT DOCUMENTS

| | | |
|---|---|---|
| JP | 10 052039 | 2/1998 |
| WO | WO 97/38479 | 10/1997 |
| WO | WO 2008/079870 | 7/2008 |

OTHER PUBLICATIONS

Patent Abstracts of Japan vol. 1998, No. 06, Apr. 30, 1998 & JP 10 052039 A (Meidensha Corp.), Feb. 20, 1998.

European Search Report issued in European Patent Application No. EP00310011 on Apr. 3, 2001 (8 pages).

* cited by examiner

COMPUTED TOMOGRAPHY SYSTEMS

This application is a continuation-in-part of U.S. application Ser. No. 12/154,013, filed on May 18, 2008, which is a divisional of U.S. application Ser. No. 11/283,058, filed Nov. 18, 2005; now U.S. Pat. No. 7,375,993, which is a continuation of U.S. Application Ser. No. 10/801,079, filed on Mar. 15, 2004, now U.S. Pat. No. 6,967,559, which is a continuation of U.S. application Ser. No. 09/711,789, filed on Nov. 13, 2000, now U.S. Pat. No. 6,738,275, which claims priority from U.S. Provisional Appl. 60/164,541, filed on Nov. 10, 1999, wherein the disclosures provided in the above-cited documents are incorporated herein by reference in their entireties.

The present inventions relate to different systems for powering X-ray sources used in different medical and non-medical applications, including computed tomography. The novel power supplies include a stack of medium-voltage high-frequency inverters for generating power.

BACKGROUND OF THE INVENTION

Various X-ray generators have been used to supply regulated, high-voltage, DC power to X-ray producing vacuum tubes. To generate X-rays, high-voltage is applied between the anode and the cathode of the vacuum tube. There have been various known systems for generating the required high-voltage.

SUMMARY OF THE INVENTION

In general, the X-ray emissions are controlled by the applied voltage or potential between the anode and the cathode, as well as by the anode current. X-ray energy is controlled by the applied voltage, typically between 40 kV and 150 kV for medical applications, but sometimes as low as 20 kV as in mammography. X-ray intensity is determined by anode current, which is controlled by varying filament power. Varying filament power changes the filament temperature, thus varying the electron emission of the cathode. Most electrons emitted by the cathode reach the anode and constitute anode current. Filament power ranges from a few tens to a few hundred watts. Typically anode currents range from as low as 500 microamperes, as in lower power continuous fluoroscopy, to as high as 1 ampere, as in conventional radiography or during cine-radiography runs and computed-tomography (CT) scans.

The high-voltage is either applied continuously, though at low power levels, or as medium to high power pulses or pulse trains. In continuous mode, typical power levels are on the order of 1 kilowatt (100 kV×1 ma); in pulsed mode, instantaneous power levels are on the order of 150 kW (150 kV×1 A). X-ray generators used in medial applications have power ratings in the 10 to 100 kilowatt range.

X-ray generators typically employ one of two fundamental methods to produce the required high-voltage, DC power. In one method, line frequency generators use a step-up transformer to raise the AC line voltage to the desired level, and then rectify and filter the high AC voltage to obtain DC voltage. Due to the low line frequency and high power levels involved, and due to the high amount of insulation required, the transformer and filter capacitors are very bulky and very expensive. The use of dielectric insulated oil is mandatory to achieve the level of insulation required and to assist in dissipating the heat lost in the transformer windings and other components. The insulating transformer oil creates a large space requirement, creates very heavy equipment, and requires seals which often allow the transformer oil to leak and create an environment hazard as well as degrade the line frequency generator. The second method of X-ray generator involves a high-frequency generator using a high-frequency inverter typically made up of a high-frequency oscillator, a high-frequency high-voltage transformer, a high-frequency high-voltage rectifier, and a high-frequency high-voltage filter to obtain the high DC voltage required. The inverter is powered directly from a low-voltage DC source such as a battery bank or from the rectified and filtered AC line. Although many inverter topologies exist, high frequency generators typically use a resonant-inverter topology. In this configuration, the high frequency oscillator drives the primary winding of the transformer through a damped resonant circuit. This resonant circuit is generally composed of an inductor, a capacitor, and an equivalent resistance due to the external load connected to the secondary winding of the transformer, and reflected to the primary. The resonant circuit can be configured with the inductor, capacitor, and resistor in parallel or series. Power transferred to the load, thus voltage across the load, can be varied by changing the oscillator frequency. Power is maximum when the circuit is at resonance, that is, when the inductive reactance is exactly cancelled by the capacitive reactance of the circuit. Power drops when the oscillator frequency is either lower or higher than resonant frequency. High-frequency generators are much smaller and lighter than comparable line frequency generators, due to the reduced size of the transformers, capacitors, and inductors; however, typical high-frequency generators still require use of dielectric insulating oil to insulate and dissipate heat in the transformer windings and other components.

All X-ray generators use a high-voltage divider to measure accurately the high-voltage outputs. The high-voltage divider is made up of a string of equal value multi-megaohm resistors, the top of which is connected to the high-voltage output, the bottom of it going to a voltage sampling resistor, that in turn is connected to the high-voltage return which is grounded. Typical divider ratio is 1V:10 kV and divider current is on the order of 1 milliampere (ma). High-voltage dividers have to be frequency-compensated by connecting a small capacitor in parallel with each resistor, such as to maintain divider accuracy and pulse shape integrity when the high-voltage is pulsed. Capacitor values must be many times larger than the stray capacitances that exist between the divider sections and the surroundings. High-voltage capacitors are costly and large, so a typical capacitor-compensated high-voltage divider is a bulky and expensive device.

Instead of using compensating capacitors, high-voltage dividers can also be guarded by enclosing each resistor in a cylindrical shield section that is maintained at about the same potential as the enclosed resistor, as disclosed in U.S. Pat. Nos. 5,023,769 and 5,391,977. This potential is obtained through a second resistor string that is not used for measurement. This ensures that essentially no current flows through the inevitable stray capacitances since there is very little potential difference between any resistor of the precision divider and its own guard section.

The high-voltage output of the X-ray generator is connected to the X-ray tube anode and cathode by means of a pair of high-voltage coaxial cables. Cable lengths range from a few feet to about 50 feet. The inner conductor carries the high tension and is thoroughly insulated from the outer coaxial conductor, which is solidly grounded for safety purposes. Because of their coaxial construction, high-voltage cables behave as transmission lines; characteristic impedance is normally 50 ohms and capacitance is on the order of 50 picofarads per foot. Tube arcing between anode and cathode, or between either tube electrode and ground, is a rather frequent occurrence. It is equivalent to a momentary short circuit across the tube end of the high-voltage cable. Since the high-voltage cable acts as a transmission line, the short circuit typically reflects back all of the energy received from the line. The reflected energy adds to the incoming energy and provokes a very large voltage spike at the generator end of the line. The sum of the high-voltage output from the generator and the spike will oscillate between twice the normal high-voltage output and some negative value, inverting in fact the polarity of the output, until all of the reflected energy has been damped. Due to the large spike, output components of an unprotected X-ray generator will catastrophically and irreversibly fail when the X-ray tube arcs. Nevertheless, many cost-conscious X-ray high-frequency generators are not protected against tube arcing. Tube arc protection is typically implemented with a specially designed lossy inductor, where the inductance of the device slows the rise time of the fault current, and the resistance of the device damps the reflected energy, as disclosed in U.S. Pat. Nos. 5,241,260 and 5,495,165. Slowing the rise time of the fault current allows time for other protective devices, such as fuses and shutdown circuitry, to take over and limit the value of the fault current to tolerable levels. The damping resistance avoids resonance between the high-voltage cable and the large filter capacitors of the generator output. The arc protection inductor is large and expensive since it must be carefully designed to withstand the very strong electromagnetic forces and high-voltages that develop across it during the onset of the fault.

Precise control of the voltage and phase of the power supply to an X-ray tube is important to ensure proper imaging for diagnostic purposes and to avoid unnecessary exposure of the patient to X-ray radiation which does not produce a useable image. For example, during a conventional radiographic gastrointestinal analysis, the patient ingests a radioopaque liquid containing barium. When the patient ingests the liquid, the doctor turns on the X-ray generating tube at a low level and positions the patient between the X-ray tube and a fluoroscopic screen. The doctor analyses the patient's gastrointestinal track while the barium flows through it. When the doctor sees a part of the procedure he/she wants to record, she typically replaces the fluoroscopic screen with a photographic plate and increases the X-ray to a level intense enough to expose the plate.

Typical high-voltage generators are available for up to 100 kilowatts for medical applications, because of component limitations, rapidly rising costs of components, and because electromagnetic interference emissions become increasingly more expensive to contain. However, many medical procedures require more power and cannot use existing high-frequency generators. Furthermore, load currents below 10 milliamperes are also hard to achieve for high-voltage generators. This value is too high for low-power, continuous fluoroscopy which typically runs at 0.5 to 2.0 milliamperes. This minimum current constraint is mostly dictated by the stability criteria of the voltage control loop which requires some amount of damping in the output circuit. In the specific case of the variable frequency resonant inverter, the frequency range required to control output power over such a large range also limits the practical span of power output available from the generator. Furthermore, while power efficiency for high-frequency, high-voltage generators at full output can reach 85%, that is, 15% of the input power is lost as heat, efficiency is generally very poor at low power levels such as used in fluoroscopy. Indeed, power losses in high frequency generators are mostly due to switching losses of the active inverted devices. In particular, in the variable frequency, resonant inverter typology, reactive power remains high in the resonant circuit even when the real power delivered to the load is small and, therefore, switch losses remain consequently high.

In the pulsed fluoroscopy operating mode, the X-ray generator output is repetitively switched on and off, typically in synchronism with an X-ray detecting device such as a video camera coupled to a fluoroscopic imaging intensifier. This mode is widely used since it reduces the X-ray dose by turning on the X-ray source only when the detecting device is ready to acquire a new image, and turning it off while the detecting device is busy processing the acquired image. In pulsed fluoroscopy mode, typical pulse repetition rates range from 10 to 90 pulses per second and typical pulse widths from 1 to 10 milliseconds. A 100 microsecond rise time represents 10% of the pulse width of a 1 millisecond pulse. Repetitively pulsing an X-ray generator output on and off means that the output of a generator goes from zero to approximately 100 kV and back to zero, for each pulse. The X-ray tube current will also be pulse-shaped, its peak value being determined by the generator output voltage and by the tube filament temperature set by filament current. Typical peak currents range from 5 ma to 50 ma.

As mentioned above, the high-voltage output of the X-ray generator is connected to the X-ray tube by means of a pair of high-voltage coaxial cables that have a capacitance on the order of 50 picofarads per foot and links ranging from 3 to 50 feet. Thus, the total capacitance of these cables must be charged to the full output voltage, and discharged back to zero, for every pulse of the generator output. The charge current must be supplied by the generator and its intensity determines the rate of rise of the voltage by the well-known formula $i=C\,dv/dt$ and consequently the rise time. In this same manner, the discharge current must flow through a cable discharge circuit that shunts the cable capacitance and is triggered every time discharging is required. The intensity of this discharge current then determines the fall time of the pulse. For example, a 20 foot cable will have a capacitance of around 1,000 picofarads and the charge, or discharge, current will need to be 1,000 milliamps to raise, or drop, the voltage by 100 kV in 100 microseconds.

Pulsed fluoroscopy presents a special challenge to the designers of control loops for all types of X-ray generators in the sense that instantaneous voltage, current, and power vary very widely and very rapidly during each of the repetitive pulses. In the high frequency generator that uses the resonant inverter topology, where output power is solely controlled by varying the oscillator frequency, this is nearly impossible to do neatly without a further discharge module with high-voltage and low-voltage portions in a circuit to limit the "tail" in the output waveform and increase image quality by discharging any capacitive voltage remaining on the cable connected the same, as disclosed in U.S. Pat. No. 5,056,125.

In one illustrative embodiment, a power supply for a device which has a load includes a first resonant generator and a second resonant generator connected in parallel and each with a phase output. A control circuit is coupled to the first and second generators and controls the first and second phase outputs. The first and second phase outputs are summed to provide a variable power supply to the load.

In another illustrative embodiment, a method controls first and second generators connected in parallel. The generators each have a phase output. The method includes the steps of setting a first phase to the output of the first generator and setting a second phase to the output of the second generator. The method further includes the step of selectively shifting at least one phase output of the generators to achieve a predetermined magnitude of a voltage in a predetermined time.

In still another embodiment, an apparatus for supplying operating power to an X-ray generating source is disclosed. A frequency oscillator mechanism generates an oscillator frequency. A plurality of magnetically coupled inverter modules are coupled to a plurality of resonant circuits. The resonant circuits include an inductor mechanism, a voltage limiting mechanism, and a resistor mechanism. The apparatus also includes an X-ray generating source.

In yet another illustrative embodiment, an apparatus for supplying operating power to a load device is disclosed. A frequency oscillator mechanism generates an oscillator frequency. A plurality of magnetically coupled inverter modules receives the oscillator frequency and is coupled to a plurality of resonant circuits. The resonant circuits include an inductor mechanism, a voltage limiting mechanism, and a resistor mechanism. The plurality of inverter modules are each coupled to at least one transformer device having a primary winding and a secondary winding. The apparatus also includes at least one DC voltage rectifier mechanism and a load sharing mechanism which substantially equalizes the power load on each inverter module.

In another illustrative embodiment, an apparatus for supplying operating power to a load device is disclosed. A frequency oscillator mechanism generates an oscillator frequency. A plurality of magnetically coupled inverter modules receives the oscillator frequency and is coupled to a plurality of resonant circuits. The resonant circuits include an inductor mechanism, a voltage limiting mechanism, and a resistor mechanism. The plurality of inverter modules are each coupled to at least one transformer device having a primary winding and a secondary winding. The apparatus also includes at least one DC voltage rectifier mechanism and a means for sharing the load of the load device substantially equally between the plurality of resonant inverter modules.

In still another embodiment of a system for generating X-ray beams utilizing a plurality of inverter modules, a method for controlling power is disclosed. The method includes the steps of arranging the plurality of inverter modules interconnected by at least one magnetic coupling and selectively disconnecting at least one module from the magnetic coupling.

A high-voltage power supply includes a first resonant inverter, a second resonant, a control circuit and a high-voltage transformer. The control circuit includes a voltage controlled oscillator and a phase shifter, and is coupled to the first inverter and to the second inverter constructed to control the phase difference between the first output signal and the second output signal. The high-voltage transformer includes a primary side and a secondary side providing power to a load, wherein the primary side includes a first pair of primary coils connected to receive the first output signal and includes a second pair of primary coils connected to receive the second output signal. The first output signal having a first phase and the second output signal having a second phase are summed to provide a variable power to the load depending on the phase difference between the first phase and the second phase.

In the power supply, the first output signal is coupled to the first pair of primary coils using a first switch and the second output signal is coupled to the second pair of primary coils using a second switch and wherein the first and second switches are selectively openable while providing power to the load.

The secondary side includes plurality of secondary coils each the secondary coil corresponding to one primary coil. The control circuit may comprise a control signal generator providing input to at least one of the inverters. The control signal generator may include the voltage controlled oscillator, the phase shifter, an amplifier and an isolation transformer. The control circuit is constructed to generate a first clock output coupled to the first inverter, and generate a second clock output coupled to the second inverter. The first inverter and the second inverter may receive one clock input having the same frequency and the same phase. The first inverter and the second inverter may receive clock inputs at the same frequency but having different phases (or even different frequencies). The control circuit may be constructed for pulse width modulation of the first and second resonant inverters. The power supply may include a load sharing mechanism constructed to substantially equalize power load on each resonant inverter. The load sharing mechanism may include a first tertiary primary coil associated with the first pair of primary coils and a second tertiary primary coil associated with the second pair of primary coils, the tertiary primary coils being connected in parallel.

The power supply may include a first switch constructed and arranged to couple the first output signal to the first pair of primary coils, and a second switch constructed and arranged to couple the second output signal to the second pair of primary coils, the first and second switches being selectively openable while providing power to the load.

The power supply may include a third resonant inverter providing a third output signal, and a fourth resonant inverter providing a fourth output signal; and at least another one high-voltage transformer including a primary side and a secondary side providing power to a load; the primary side including a third pair of primary coils connected in parallel to receive the third output signal and including a fourth pair of primary coils connected in parallel to receive the fourth output signal, wherein the control circuit is constructed to control a phase difference between the third output signal and the fourth output signal.

In another embodiment of a system for generating X-ray beams utilizing a plurality of inverter modules, a method for dissipating is disclosed. The method includes the steps of arranging the plurality of inverter modules interconnected by at least one magnetic coupling and selectively disconnecting at least one module from the magnetic coupling.

In yet another embodiment, an apparatus supplying operating power to an X-ray generating source is disclosed. A transistor switching circuit includes a slew rate detecting circuit, a variable delay circuit, and a feedback loop coupling the slew rate detecting circuit to the variable delay circuit.

In a further embodiment, a method for switching in a system for generating X-ray beams is disclosed. The method includes the steps of sensing a slew rate and generating a delay time for switching transistors based on the slew rate. The transistors invert a current. The method also includes the step of switching the transistors.

In another embodiment, a shielded resistor divider circuit is disclosed. A resistor mechanism has opposing end terminals and a shield limits electrical noise and stray capacitance from interfering with the operation of the resistor mechanism. The shield includes a plurality of paired conductive members disposed along the length of the resistor mechanism and has opposing end terminals. The pairs of conductive members separate the resistor mechanism into separate portions by providing alternating first and second pairs of conductive members along the length of the resistor mechanism. The shield also comprises a capacitor series comprising a plurality of serially connected capacitor mechanisms disposed a predetermined distance from the resistor mechanism and having opposing end terminals. Each capacitor mechanism is connected between adjacent first and second pairs of conductive members which are connected to the end terminals of the capacitor series. The dynamic impedance of the capacitor series is less than the dynamic impedance of the resistor mechanism. The shield also includes a diode bridge series which has a plurality of connected diode bridges coupled to the capacitor series. The end terminals of the resistor mechanism are connected between a higher-voltage potential and a lower voltage potential. The end terminals of the capacitor series are connected between the higher voltage potential and ground. Electrical noise and stray capacitance is coupled to the capacitor series and does not interfere with the resistor mechanism.

In still another embodiment, a shielded resistor circuit is disclosed. A first insulating sheet and a second insulating sheet each have an opposing inner and outer face. The sheets are disposed in parallel with their inner faces adjacent one another. A resistor mechanism is disposed between the inner faces. A first series of paired conductive members are disposed adjacent the resistor mechanism. Each pair of the first series of conductive members includes a first member disposed on one of the inner faces, a second member disposed on the outer face opposing the other inner face, and means for connecting the first and second members. A second series of paired conductive members are disposed adjacent the resistor mechanism. Each pair of the second series of conductive members includes a third member disposed on the outer face opposing the one inner face, a fourth member disposed on the other inner face, and means for connecting the third and fourth members. Each pair of the second series is disposed between two pairs of the first series. The combined first and second series have opposing end terminals. A capacitor series, including a plurality of serially connected capacitor mechanisms, is disposed between the inner faces a predetermined distance from the resistor mechanism and has opposing end terminals. Each capacitor mechanism is connected to an adjacent pair of the first series and a pair of the second series. The end terminals of the conductive members are connected to the end terminals of the capacitor series. The dynamic impedance of the capacitor series is less than the dynamic impedance of the resistor mechanism. The shielded circuit also comprises a diode bridge series comprising a plurality of connected diode bridges coupled to the capacitor series. The end terminals of the resistor mechanism are connected between a higher-voltage potential and a lower-voltage potential. The end terminals of the capacitor series are connected between the higher-voltage potential and ground. Electrical noise is coupled to the capacitor series and does not interfere with the resistor mechanism.

In yet another embodiment, an X-ray generating source and regulated power supply is disclosed including an X-ray generating source and a regulator circuit. The regulator circuit receives an input signal and regulates at least one of a duration and an amplitude of the input signal to produce a high-voltage output signal for operating the X-ray generating source. A protection circuit is disposed between the regulator circuit and the X-ray generating source for limiting a rate of change of a transient voltage spike produced at the source to a predetermined value and protecting the regulator circuit. A plurality of series connected resistor mechanisms are coupled to the source of the transient high-voltage spike. The resistor mechanism has a stray inductance.

In a further embodiment, a transformer device is disclosed. A single core includes a substantially rectangular-shaped ferrite core having four sides. Each side is a section of the rectangular-shaped magnet. Two primary windings are mounted on the core. Each primary winding is on an opposing side of the rectangular ferrite core. Two secondary windings are mounted on the core. Each secondary winding is on one of the same opposing sides of the rectangular-shaped ferrite core.

In another embodiment, a transformer device for an X-ray generating device is disclosed. A single core includes a substantially rectangular-shaped magnet having four sides. Each side is a section of the rectangular-shaped ferrite core. Two primary windings are mounted on the core. Each primary winding is on an opposing side of the rectangular magnet. Two secondary windings are mounted on the core. Each secondary winding is on one of the same opposing sides of the rectangular-shaped ferrite core.

According to yet another aspect, a power delivery system for a computed tomography system includes at least one transformer (e.g., an isolation transformer, a coupling transformer, an adaptation transformer), a rotary transformer, and at least two power inverters. The rotary transformer includes a stationary winding disposed on a stationary side and a rotational winding disposed on a rotating side. The isolation or adaptation transformer is coupled to the stationary winding or the rotating winding of the rotary transformer. At least two power inverters are constructed and arranged to provide power to the primary winding of the rotary transformer. The high-voltage unit is disposed on the rotating side and connected to receive power from the rotational winding and constructed to provide power to an X-ray source.

The power delivery system may include a control unit coupled to the high-voltage unit and the power inverters, wherein the control unit is constructed and cooperatively arranged with the rotary transformer to provide timing signals to the power inverters a feedback loop arrangement. The power inverters may be coupled in inverter stages.

The isolation or adaptation transformer may be designed to provide power to the stationary winding of the rotary transformer in a single or in a multi phase configuration.

The isolation or adaptation transformer may be disposed on the rotating side and designed to receive power from the rotational winding of the rotary transformer in a single or in a multi phase configuration.

The high-voltage unit is designed to receive power from the transformer and is disposed on the rotating side. The X-ray source is disposed on the rotating side.

The stationary winding may include a power stationary winding, and the rotating winding may include a power rotating winding.

The power delivery system may include an inverter adaptation circuit constructed to receive AC power generated by at least one of the power inverters and provide AC power to the power stationary winding of the rotary transformer. The inverter adaptation circuit may include the transformer providing power to the stationary winding. The power delivery system may include an inverter adaptation circuit constructed to receive AC power from the power rotating winding of the rotary transformer and provide AC power to the high-voltage unit. The inverter adaptation circuit may include the transformer receiving power from the rotating winding disposed on the rotating side. The stationary winding may include a control stationary winding, and the rotating winding includes a control rotating winding.

In the power delivery system, the control unit may include a stationary controller adaptation circuit constructed to receive AC signals from a stationary controller and to provide AC signal to the control stationary winding of the rotary transformer. The stationary controller adaptation circuit may include an adaptation coil.

In the power delivery system, the control unit may include a rotating controller adaptation circuit constructed to receive AC signals from control rotating winding. The rotating controller adaptation circuit may include an adaptation coil.

According to yet another aspect, described is a novel device for isolating output of power inverters from a rotary transformer adapted to couple power between a stationary winding disposed on a stationary side and a rotational winding disposed on a rotating side of the rotary transformer. The device includes an isolation transformer constructed and arranged to receive power generated by power inverters. The isolation transformer is constructed to magnetically couple outputs from at least two power inverters and to drive a stationary winding disposed on a stationary side of a rotary transformer.

According to yet another aspect, described is a novel device for isolating output of power inverters from a rotary transformer adapted to couple power between a stationary winding disposed on a stationary side and a rotational winding disposed on a rotating side of the rotary transformer. The device includes an isolation transformer constructed and arranged to receive power from a rotational winding disposed on a rotating side of a rotary transformer.

According to yet another aspect, described is a novel transformer in a power delivery system that transfers power between stationary coupling elements on a stationary side and rotational coupling elements on a rotational side, the rotary transformer including a primary winding and a secondary winding. The windings of the rotary transformer may be configured for dual use that allows for bi-directional communication through one or more coupled high-frequency modulated signals. The dual use may include a first use in which power signals or timing signals are transmitted through the windings, and may include a second use that provides for bi-directional communication between the stationary side and the rotational side.

Various embodiments of the present invention provide certain advantages and overcome certain drawbacks of prior devices, systems, and methods. Embodiments of the invention may not share the same advantages and those that do may not share them under all circumstances. This being said, the present invention provides numerous advantages including the advantages of achieving high-voltage output in an X-ray generator; use of inexpensive and common parts to decrease the costs of maintenance and manufacture; smaller, lighter, and environmentally reliable generators; generating infinite run time in X-ray generators without over-heating; decrease need for environmental cooling fans; limiting high thermal and electrostatic stress concentrations in a power generator; limiting losses at less than full power in a power generator; increasing the duty factor of a high-voltage generator; permitting low current operations including low-power continuous fluoroscopy with a high-voltage generator; limiting effects of single-shot and recurrent tube arcing; permitting continuous operation with defective inverter modules; permitting single phase and three-phase AC supply or direct supply from a DC source for a high-voltage generator; and generating shorter rise time pulses required by high performance pulsed fluoroscopy.

Further features and advantages of the present invention as well as the structure and method of various embodiments of the present invention are described herein in detail below with reference to the accompanying drawings.

DETAILED DESCRIPTION OF THE PREFERRED EMBODIMENT

Figure 1:
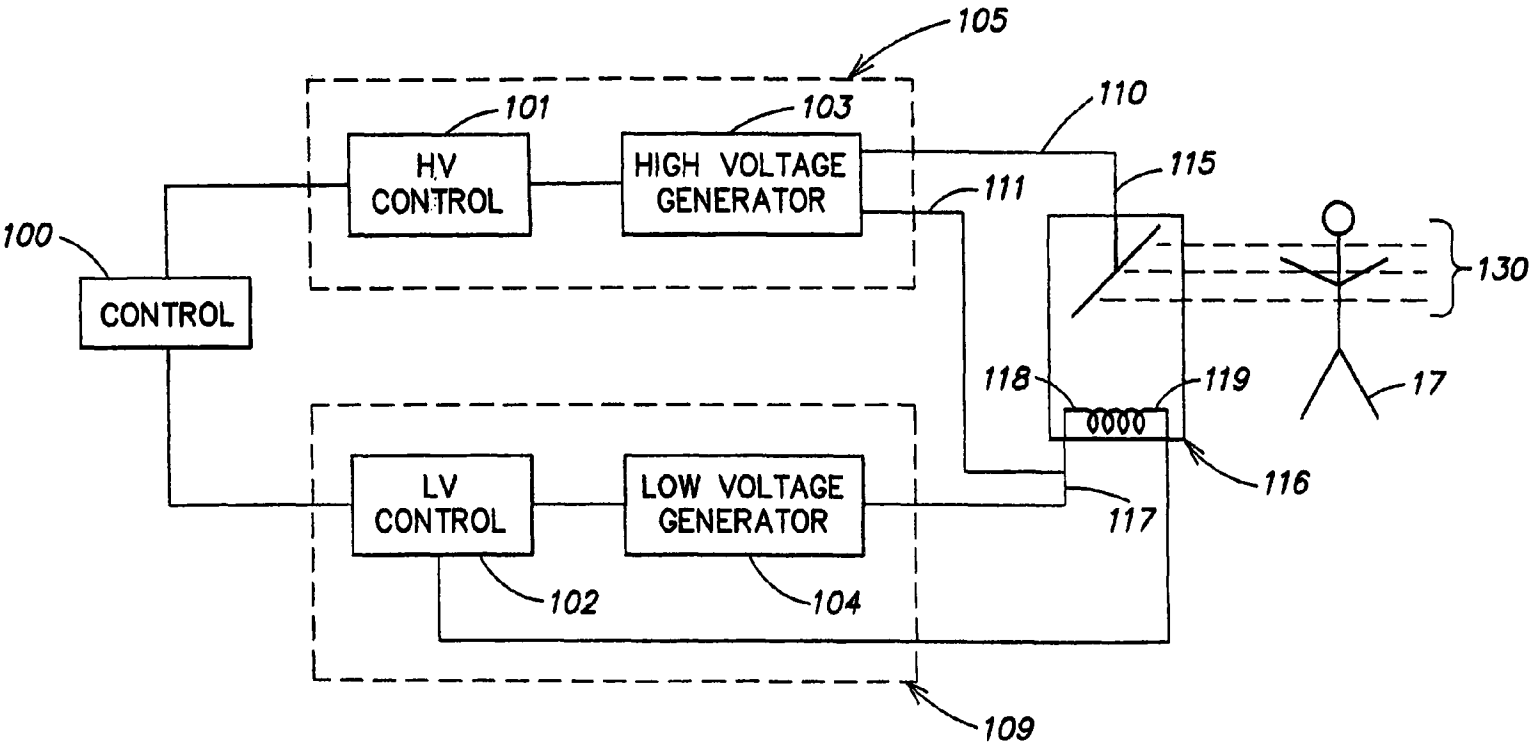
FIG. 1 is a high-level block diagram of a high-voltage power supply system for an X-ray source.

In a first embodiment of the present invention, as shown in FIG. 1, a high-voltage high-frequency X-ray generator comprises a control circuit 100, which couples to a high-voltage section 105 comprising a high-voltage control circuit 101 coupled to a high-voltage generator 103; further couples to a low-voltage section 109 comprising a low-voltage control circuit 102 coupled to a low-voltage generator 104. Two outputs 110,111 of the high-voltage section 105 are coupled to an anode 115 and a cathode 118, respectively, of an X-ray tube 116. An output of the low-voltage generator 104 couples to a first terminal 117 of a filament of the X-ray tube. According to an aspect of the invention, when the high-voltage section 105 supplies a voltage across the X-ray tube and the low-voltage section 109 supplies a current through the X-ray filament. The X-ray tube generates an X-ray beam 130 that irradiates a subject 17.

Figure 2:
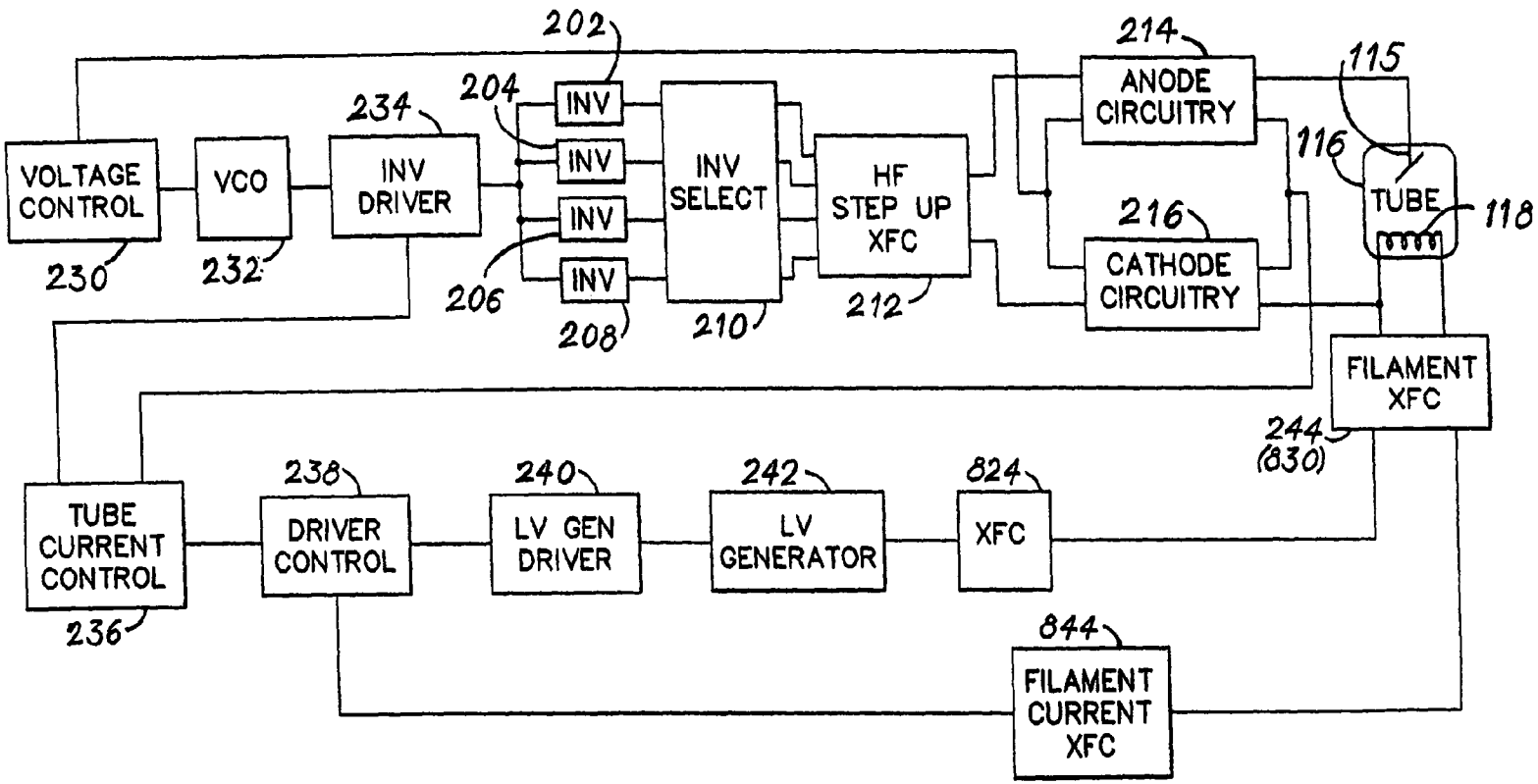
FIG. 2 is a more detailed block diagram of the high-voltage power supply system of FIG. 1.

Referring to FIG. 2, a High-voltage High Frequency X-ray Generator can be assembled by coupling four medium voltage high frequency inverter modules 202, 204, 206 and 208 in series, as shown in FIG. 2. In FIG. 2, two of the four medium voltage high frequency inverter modules provide a current to a primary winding of a high frequency step up transformer 212. The high frequency step up transformer 212 subsequently couples to an anode high-voltage module 214, which provides operating power to anode of 115 X-ray tube 116. A second pair of the four medium voltage high frequency modules couples to a high frequency step up transformer 212, which subsequently couples to a cathode high-voltage module 216. The cathode high-voltage module supplies operating power to cathode 118 of the X-ray tube.

Figure 2A:
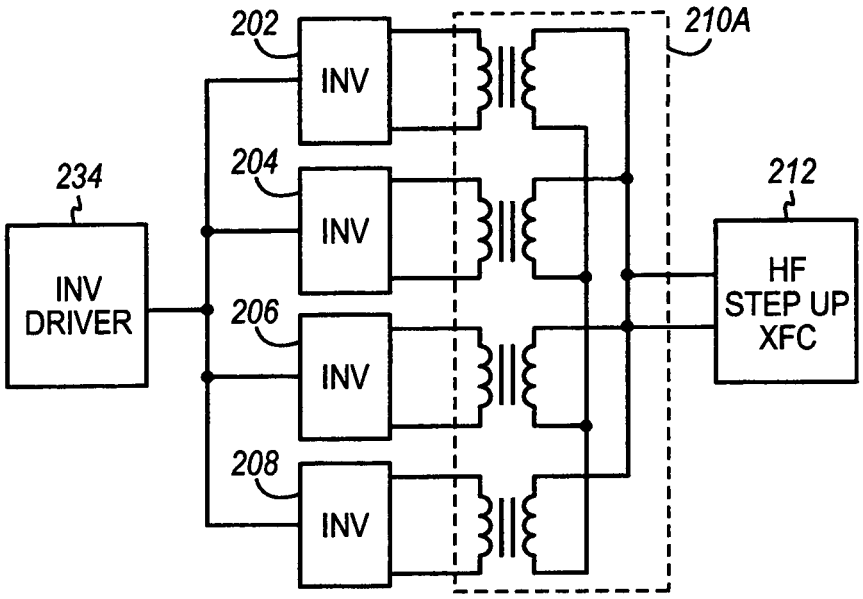
FIGS. 2A and 2B show schematically a plurality of inverter modules outputs connected in parallel and in series, respectively.
Figure 2B:
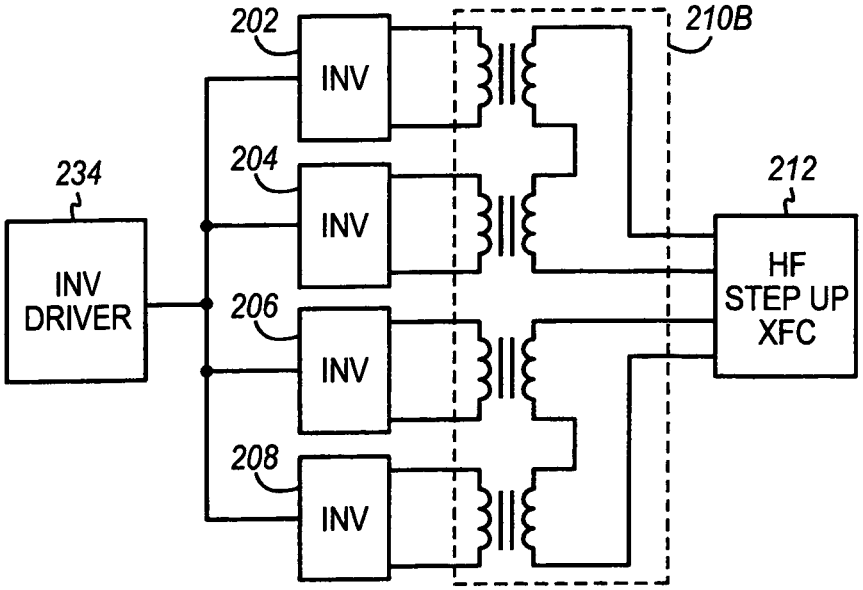

In an embodiment of the present invention, a generator voltage control mechanism is implemented using a voltage control feedback loop comprising a voltage control circuit 230 coupled to a voltage controlled oscillator circuit 232; further coupled to an inverter module driver circuit 234; further coupled to a stack of the plurality of inverter modules 202, 204, 206 and 208; further coupled to an inverter module selection circuit 210; further coupled to a high frequency step-up transformer 212; further coupled to high-voltage anode module 214 and high-voltage cathode module 216; each high-voltage module further coupled to an anode and a cathode of an X-ray tube; and the output of the high-voltage modules are coupled back to the voltage control circuit 230. The plurality of inverter modules 202, 204, 206 and 208 may have their outputs connected in parallel, as shown schematically in FIG. 2A, or in series, as shown schematically in FIG. 2B.

In an embodiment of the present invention, a generator current control mechanism is implemented using a tube-current control feedback loop comprising a current control circuit 236 coupled to an inverter driver control circuit 234, inverter driver for a plurality of medium voltage high frequency inverter modules 202, 204, 206 and 208, and an output of the high-voltage modules 214 and 216. The current control circuit 236 is further coupled to a low-voltage inverter driver 240; further coupled to a low-voltage inverter module 242; further coupled to a filament transformer 244 (transformer 830 shown in FIG. 8); further coupled to the cathode of an X-ray tube 116; further coupled to a filament current measurement circuit (including a current transformer 844 shown in FIG. 8); coupled back to the inverter driver control circuit 238.

High-Voltage Section

Medium-Voltage High-Frequency Inverter Modules

In an embodiment of the present invention, four medium-voltage high-frequency (MVHF) inverter modules are used to supply high-voltage high-frequency power. According to one aspect of the invention, a MVHF inverter module comprises four insulated-gate-bipolar-transistors (IGBTs) Q1-4 coupled in a bridge configuration, shown in FIG. 7. The four IGBTs further couple four diodes D1-4 (diode 624 in FIG. 6A) and four snubber capacitors SC1-4 across source-drain terminals of each IGBT. Each IGBT is coupled to a gate driver (inverter driver 234 schematically shown in FIG. 2 and shown in detail in FIG. 6A). It should be appreciated that the number of MVHF inverter modules correspond to a voltage requirement of an output of the high-voltage generator and therefore the scope of the invention should not be limited to four inverter modules. The number of inverter modules determines both the output voltage and power. That is, 8 modules instead of four could supply twice the power at the same voltage. According to an aspect of the present invention, the inverter modules use space as insulator and fill with thermosetting compound which gives a smaller device with easier maintenance and more environmentally safe because we do not use dielectric oil. The thermosetting compound may be doped to dissipate heat with a thermally conductive filler material including, but not limited to aluminum oxide.

Figure 7:
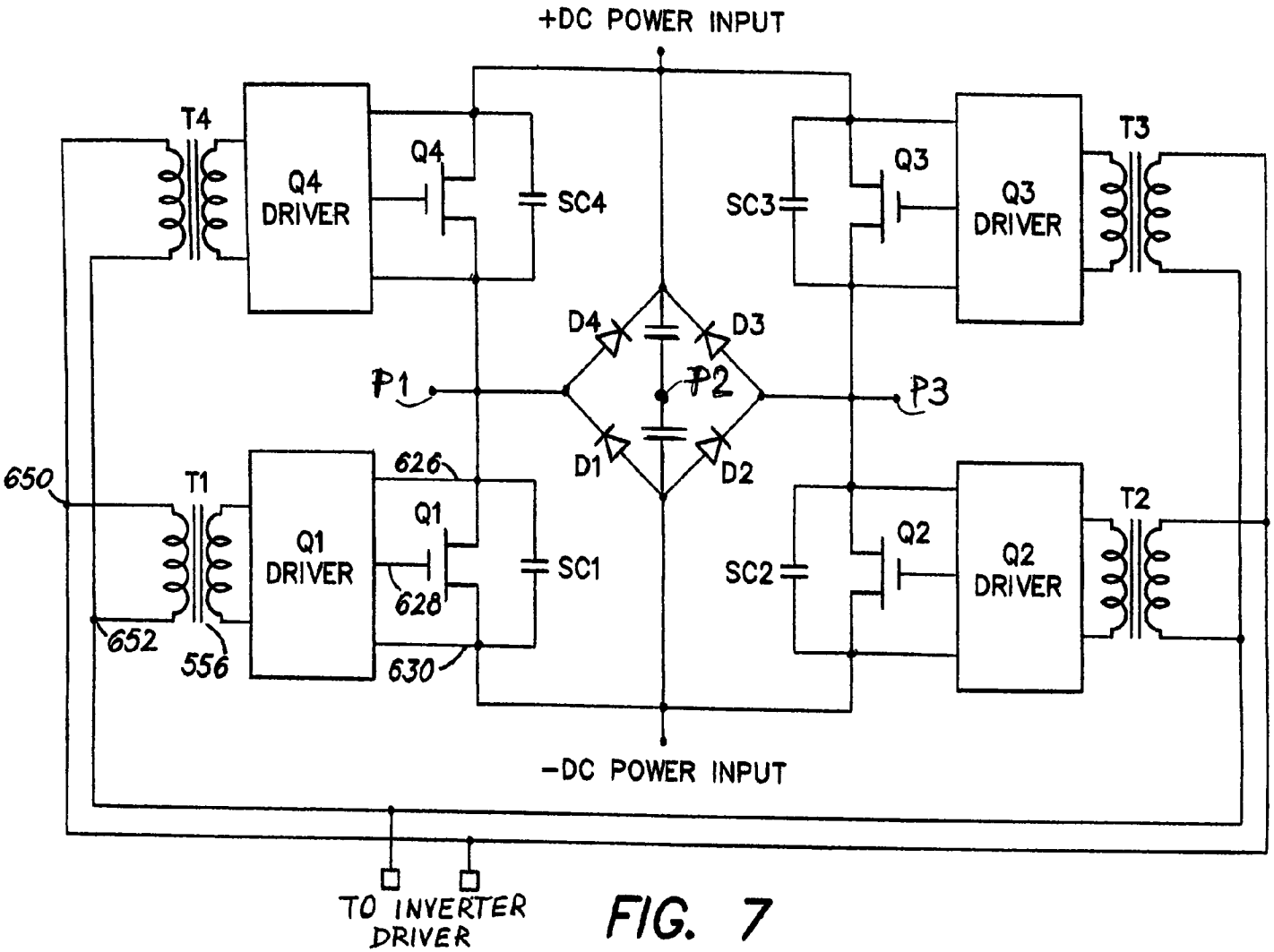
FIG. 7 is a schematic of a high-voltage inverter module used in system of FIG. 2.

As shown in FIG. 7, IGBT top left and IGBT bottom right are driven by a common gate drive signal through drive transformers T1 and T4. Similarly IGBT bottom left and IGBT top right are driven by a second common gate drive signal through an isolating drive transformer T3 and T2.

Figure 6A:
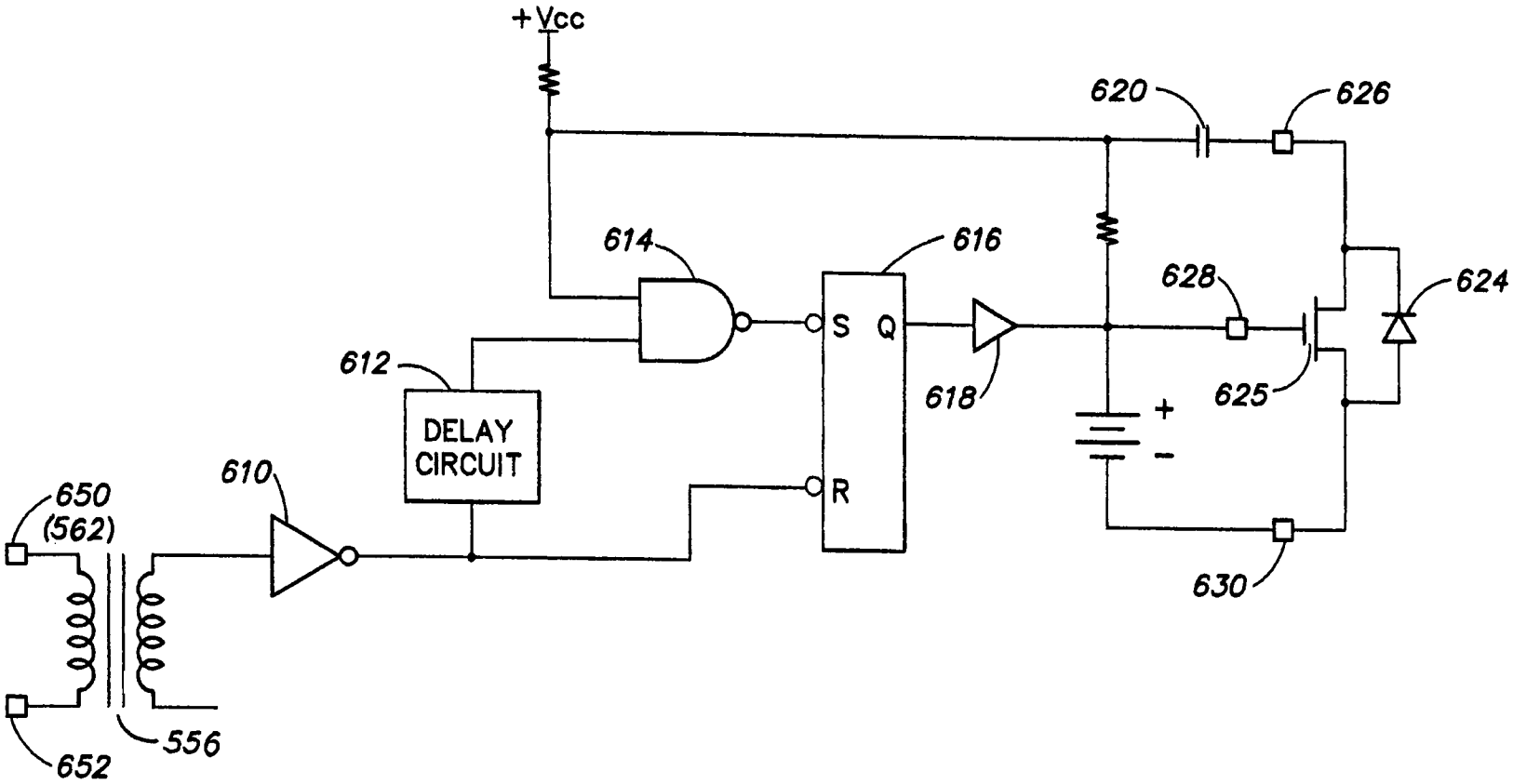
FIG. 6A is a schematic of an inverter driver in accordance with one embodiment of the invention.

As shown in FIG. 6, the output signal of each drive transformer is shaped by a driver circuit before being applied to the corresponding IGBT gate. Although the inverter output is a substantially square wave, the resonant circuit connected in series with the transformer primary acts like a narrow band path filter that attenuates all harmonics of the square wave, leaving only a fundamental frequency. Hence, the drive to the transformer is essentially sinusoidal, as shown in FIGS. 21A, 21B, 21C, and 21D.

Figure 13:
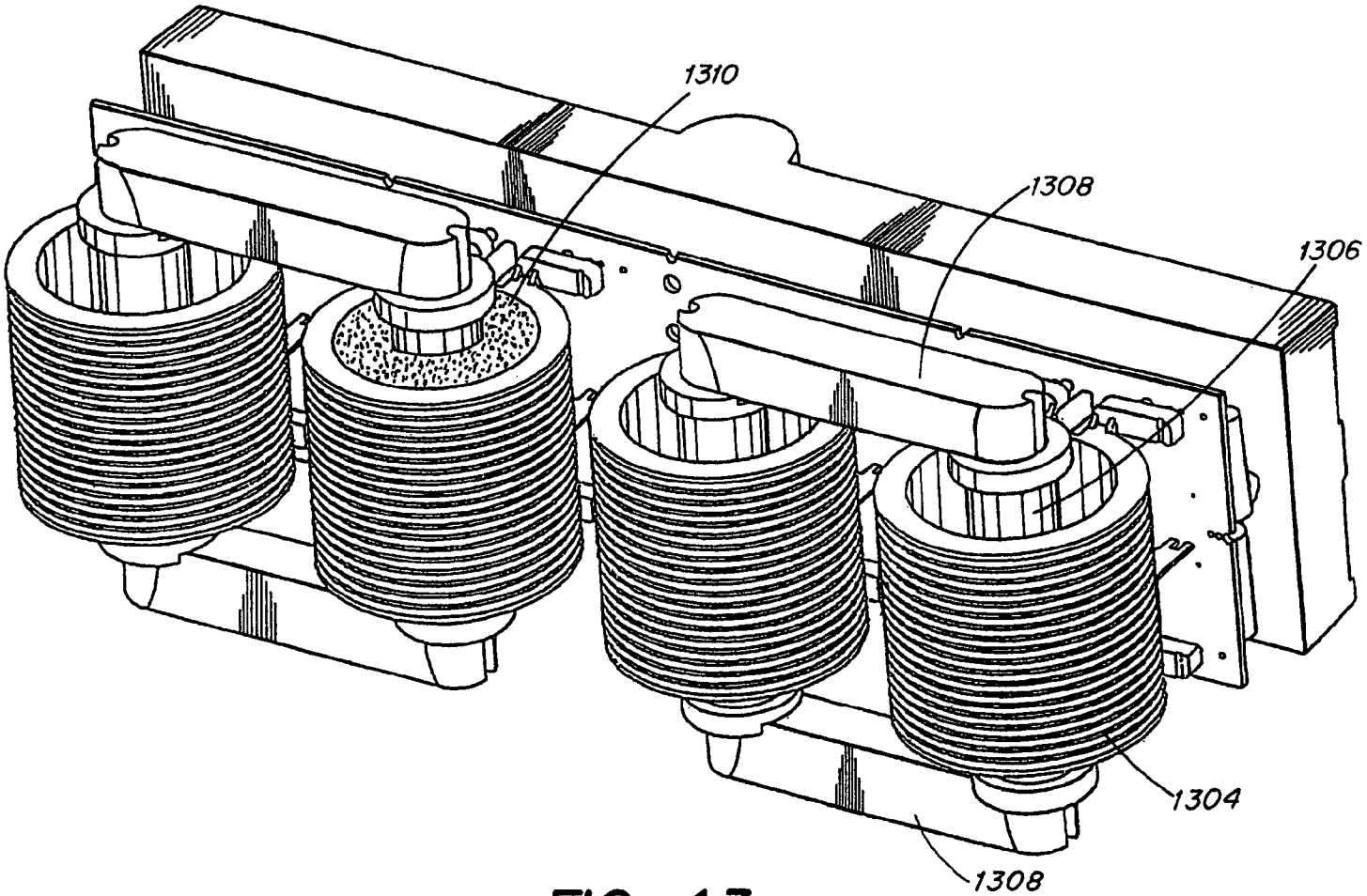
FIG. 13 is a perspective view of an anode high-voltage section used in system of FIG. 2.

As shown in FIG. 13, the step up transformer construction is symmetrical, with coils located on the opposite legs of a UU-type round section ferrite core 1308. At the core, each coil may be comprised of: (1) a cylindrical plastic bobbin slipped over the core; (2) a primary and a tertiary winding, with an equal number of turns, and wound together as bifilar windings on the top of the bobbin 1306. As shown in FIG. 13, the primary windings are installed concentric and equally spaced from the secondary bobbin 1304. The inner space 1310 between primary and secondary windings as the complete high-voltage section is embedded in silicone rubber for insulation purposes.

All windings are wound with insulated Litz wire. Typically, Litz wire is used to reduce skin effects which are important at the 100-300 kilohertz frequencies involved. Since the voltage across each section of the secondary is only about 780 volts, there is no need for paper insulation between the layers of the secondary. The ribs that separate the secondary core trenches increase high-voltage surface tracking distance. The high-voltage barrier is molded and made from Polyphenylene Oxide PPO. The trench form isolation is rated at 80 kilovolts minimum.

The two primary windings are connected in parallel and are connected to the output of the resonant inverter. The two tertiary windings are connected in parallel with all of the tertiary windings of all generator modules. Each secondary winding is parallel connected through coupling capacitors 2*a*, 3 stage rectifier stack in the high-voltage section.

The balance winding connecting all the high-voltage transformers together equalizes the DC output voltage of each section. Without this connection the tolerance of the tuned circuit components (LC) would give different output voltages in each section. Therefore the current flowing through the balance winding is to compensate automatically for this imbalance.

Figure 11:
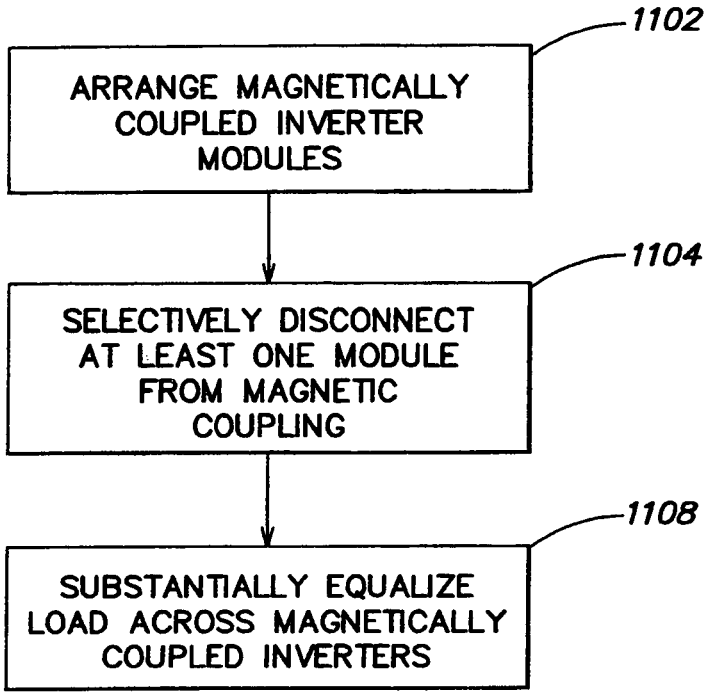
FIG. 11 is a flow chart of an embodiment of the invention.

Also a metal section X-ray tube has 20% more cathode current than anode current. This 20% must not cause an output power imbalance under this condition, the current flows through the balance winding in order to supply the cathode transformer with 20% more current. This makes it possible to obtain the same anode and cathode voltage even with this imbalance. Now referring to FIG. 11, a flow chart for an embodiment directed to a method for controlling power and/or heat dissipation in a system for generating X-ray beams utilizing a plurality of inverter modules is shown. At step 1102, the magnetically coupled inverter modules are arranged. At step 1104, at least one inverter module is selectively disconnected from the magnetic coupling. At step 108, the load across the remaining magnetically coupled inverters is substantially equalized.

High-Voltage Control Circuit

In an embodiment of the present invention, the High-voltage Generator supplies operating power to an X-ray tube operating in a Continuous Fluoroscopy mode.

In another embodiment of the present invention, the High-voltage High Frequency Generator supplies operating power to an X-ray tube operating in a Pulsed Fluoroscopy mode. Accordingly, the high-voltage control circuit 11, shown in FIG. 1, in the high-voltage section 15 of the high-voltage generator comprises a Voltage Controlled Oscillator circuit and Phase-Shifter circuit. It should be appreciated that this embodiment of the invention can also operate in a continuous fluoroscopy mode, therefore the scope of the invention should not be limited to a single-mode embodiment of either continuous fluoroscopy or pulsed fluoroscopy or a combination of both.

Figure 5:
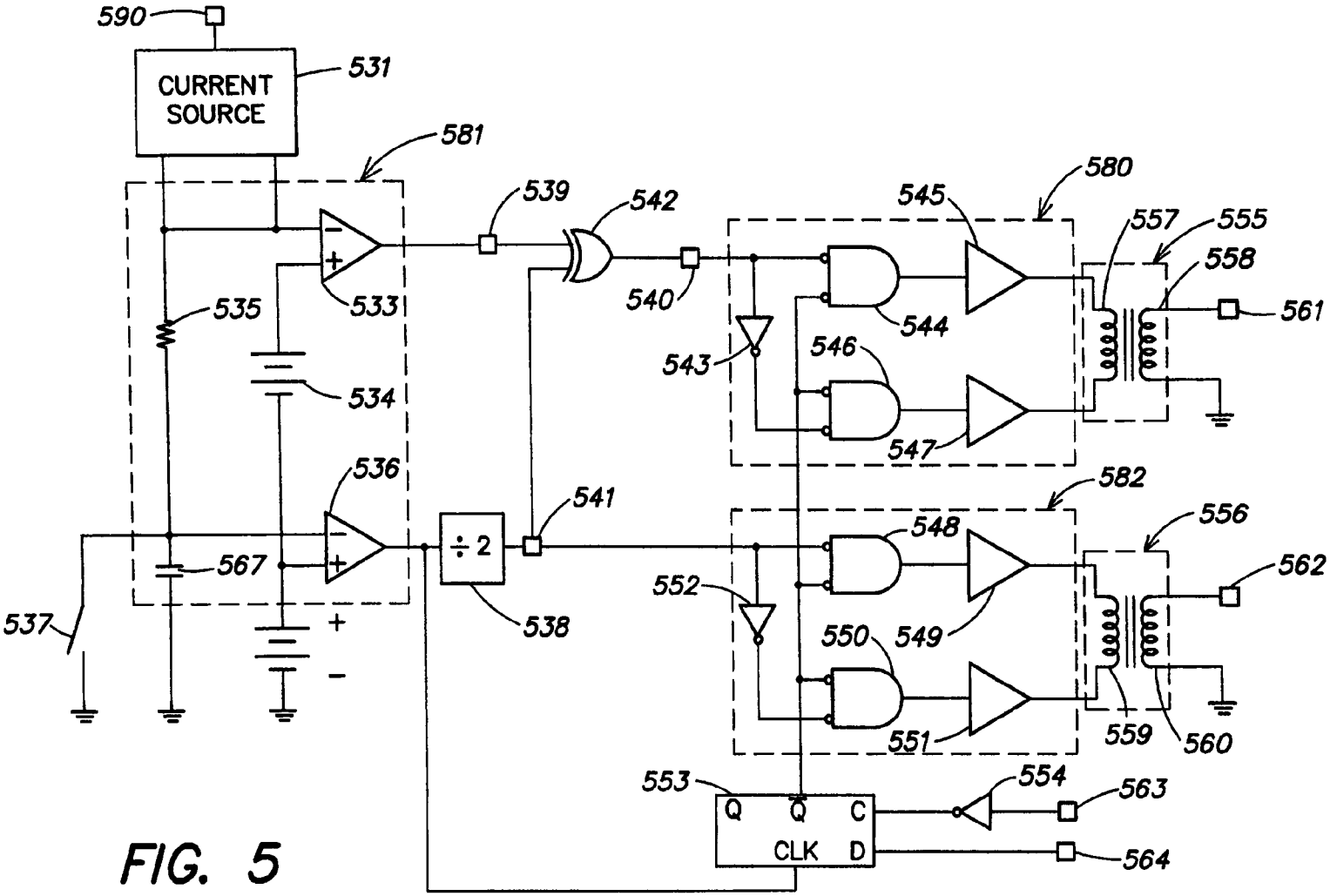
FIG. 5 is a schematic of a voltage controlled oscillator with phase shift used in system of FIG. 2.

According to an aspect of the present invention, shown in FIG. 5, the high-voltage control circuit comprises a voltage-controlled oscillator (VCO) circuit that drives a phase-shifter circuit 542, and two transformers 555 and 556. The two transformers 555 and 556 isolate amplifiers 580 and 581 from the high-voltage control circuit outputs 561 and 562 respectively. The first amplifier 581 couples to a VCO output through node 541 and drives transformer 556, while the second amplifier 580 couples to the phase-shifter circuit 542 through node 540 and drives transformer 555.

A first output of transformer 556 drives one half of the inverter modules, while a second output of transformer 555 drives another half of the inverter modules. In both halves of inverter modules, all four gates of the Insulated-Gate-Bipolar-Transistors (IGBTs) of each inverter are excited in parallel through the drive transformers T1 to T4, shown in FIG. 7. As shown in FIG. 5, the VCO controls all of the anode medium voltage high frequency modules and all of the cathode medium voltage high frequency modules.

The VCO (Voltage-Controlled Oscillator) circuit comprises a ramp generator 581, and there is a phase shift circuit for creating a variable delay signal. The ramp generator 581 comprises a timing capacitor 567 and level comparators 533 and 536. The timing capacitor 567 is linearly charged between two fixed voltage levels by a variable current source 531 that depends on a control signal coupled to node 590. The charging current from the current source determines a duration of the upward ramp. The timing capacitor 567 is rapidly discharged back to a low-voltage level when its voltage reaches a high-voltage level. The oscillator frequency increases with a control voltage, from a predetermined minimum frequency at zero volts to a predetermined maximum frequency at a maximum control voltage. However, the output frequency is halved by a flip-flop 538 that is incorporated into the circuit to obtain a symmetrical output wave form.

According to an aspect of the present invention, a voltage control feedback loop drives the VCO. The voltage control feedback loop is an operational amplifier circuit. The operational amplifier circuit comprises a proportional integral derivative (PID) high-voltage control loop. The integral and the derivative perimeters are set by a resistor-capacitor resonant (RC) circuit, associated with the operational amplifier circuit. The controller compares a predetermined value to an actual value of the high-voltage and outputs a control voltage to the VCO that is proportional to the difference between the two voltages, as well as to a derivative and an integral term. There is a single predetermined value of the high-voltage for the total anode to cathode voltage. The actual value of the high-voltage is obtained by summing a measurement of the cathode and anode voltages that is obtained from sampling resistors connected between the bottom of the high-voltage dividers and the ground. The summing is performed by operational amplifiers.

Figure 6B:
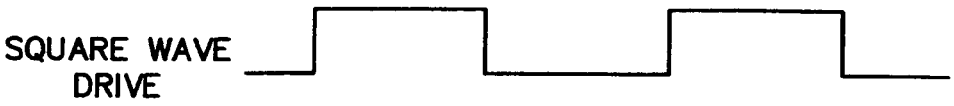
FIGS. 6B and 6C are wave forms associated with switching employed in one embodiment of the invention.
Figure 6C:
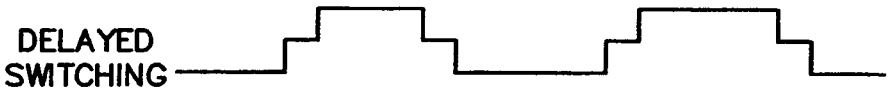

In FIG. 6B, a drive signal from the VCO is shown as a square wave form. A delay in the switching of IGBT 625 is produced by a timer 612, shown in FIG. 6A. Timer 612 is coupled to the square wave drive signal. A first rising edge of the square wave drive signal initiates the delay, as the square wave drive signal is coupled through the drive transformer. The delay ends as soon as the drain voltage of the IGBT 625 becomes slightly negative, and the latch 616 to turn on only when their drain to source voltage is about zero. Hence, a switching of the IGBT 625 at near zero crossing is achieved. A second wave form in FIG. 6C, labeled "DELAYED SWITCHING" shows a wave form of IGBT 625 switching with a dead time compensation.

Dead Time Control Mechanism (VCO and Phase Shift)

According to an aspect of the present invention, the VCO circuit in the high-voltage control circuit couples to a phase-shifter circuit. An output of the VCO circuit drives two of the inverter modules in the high-voltage section and an output of the phase-shifter circuit, a phase-shifted derivative of the VCO circuit output, drives another two of the inverter modules in the high-voltage section.

The phase shift can be set to 0 in one instance. By controlling a frequency f of the oscillator circuit with respect to a natural resonant frequency f0 of the Inductor-capacitor resonant (LC) circuits of the inverter modules, operating power supplied to the load can be controlled. As the frequency of the oscillator diverges from the resonant frequency f0, the inductive reactance of the high-voltage section become mismatched with the capacitive reactance of the high-voltage section, thus the operating power supplied to the load is decreased. In another instance, by making the ratio of f/f0 very large or very small, the power of the load can be made, theoretically, very small. However, the inventor has discovered that the practical operational range limits the ratio of f/f0 to 1:3 or 3:1. The available power range is therefore limited to approximately 1:20.

In another instance, for a fixed oscillator circuit frequency f, the phase shift angle N of a phase-shifting circuit is linearly varied from 0 to 180. Since the current supplied to the common load is the vector sum of the currents supplied by each of the N inverters, this means that at 0 phase shift, the current coming out of the second group of N/2 inverters will directly add to the currents coming out of the first group and the power delivered to the load will be at a maximum. But this also means that at 180 phase shift, the currents coming out of the second group of inverter modules will exactly cancel the currents coming out of the first group and the power delivered to the load will be substantially zero. Intermediate phase shift angles will result in intermediate values of the power delivered to the load.

Figure 10:
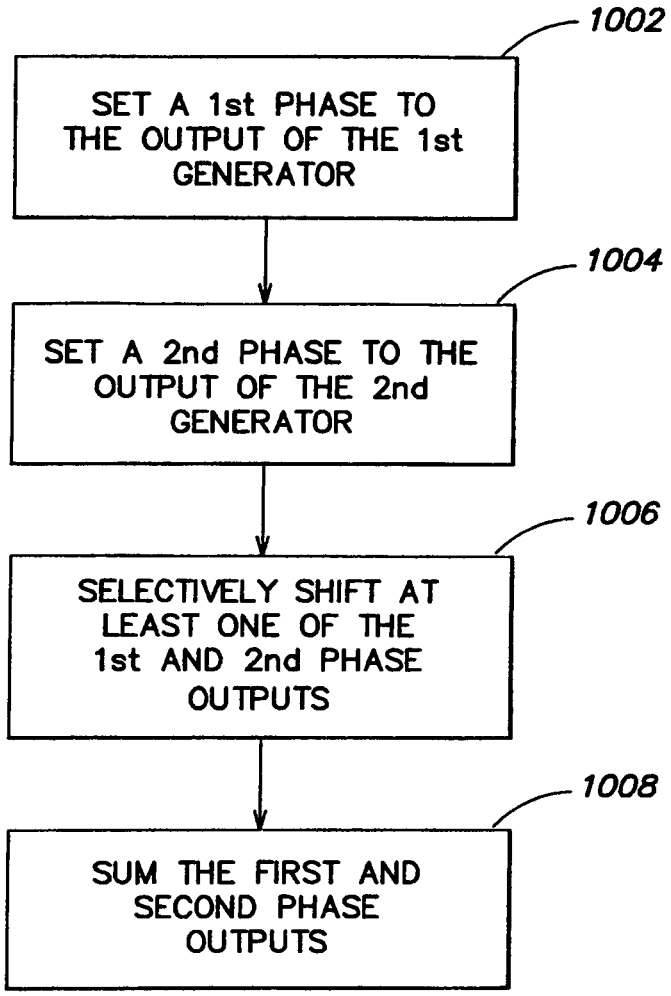
FIG. 10 is a flow chart of an embodiment of the invention.

Now referring to FIG. 10, a flow chart of an embodiment directed to a method for controlling at least two voltage generators connected in parallel is shown. At step 1002, the phase of the first generator output is set and at step 1004, the phase of the second generator output is set. At step 1006, any combination of the generator output may be phase shifted to achieve a predetermined magnitude of a voltage in a predetermined time. In one embodiment, at step 1008, the phase outputs of the at least two generators may be summed.

Inverter Driver and Automatic Dead Time Adjustment

The inverter driver circuit is coupled to each of the high-voltage transistors in the MVHF inverter module to provide a control mechanism for the switching of the IGBT high-voltage transistor 625. As shown in FIG. 6A, transformer 556 magnetically couples a clock signal from the VCO, nodes 650 and 652, to the gate driver for each of the IGBT high-voltage transistors. The transformer 556 isolates the clock signal from the DC input supply. The secondary winding of the transformer is coupled to an inverter 610. The clock signal is a substantially square waveform. The inverter 610 inverts the clock input and provides the inverted clock to a delay circuit 612. The delay of about 400 nS allows the other IGBT high-voltage transistor on the same side of the bridge to turn off before the slew rate at NAND Gate 614 is enabled. When the other IGBT high-voltage transistor on the same side of the bridge turns off, the voltage at node 626 starts falling. This falling voltage, coupled through capacitor 620, holds the output of NAND gate 614 high. The voltage at node 626 is clamped to a value no lower than the voltage at node 630 by diode 624. When the voltage at node 626 reaches the value at node 630, Capacitor 620 no longer holds the output of NAND gate 614 high and a flip flop 616 is set and thus the IGBT high-voltage transistor 625 is turned on. This technique ensures that high-voltage transistor 625 always turns on with zero volts across it and thus eliminates switching losses. The time required for the voltage at node 626 to reach the value at node 630 varies with both the DC input supply and the load current, yet high-voltage transistor 625 is always turned on as soon as this condition is met, thus increasing the inverter efficiency.

Figure 12:
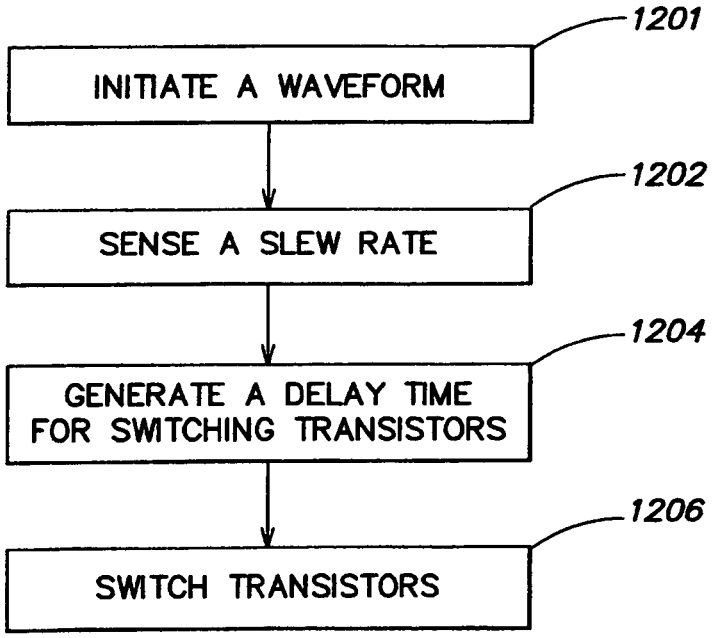
FIG. 12 is a flow chart of an embodiment of the invention.

Now referring to FIG. 12, a flow chart of an embodiment of the invention directed to a method of switching in a system for generating X-ray beams is shown. According to an aspect of the invention a waveform may be initiated at step 1201. At step 1202, a slew rate is sensed. At step 1204, a delay time for switching is generated based on the sensed slew rate. At step 1206, the transistors are switched, wherein the transistors invert a current. The delay time may be variable and/or adaptable. This delay time may limit switching losses. The delay time may vary with respect to many factors including, but not limited to, an input supply and load current. According to an aspect of the invention, the delay time is varied corresponding to the waveform initiated at step 1201 and sensed at step 1202.

High-Voltage Module

Figure 3A:
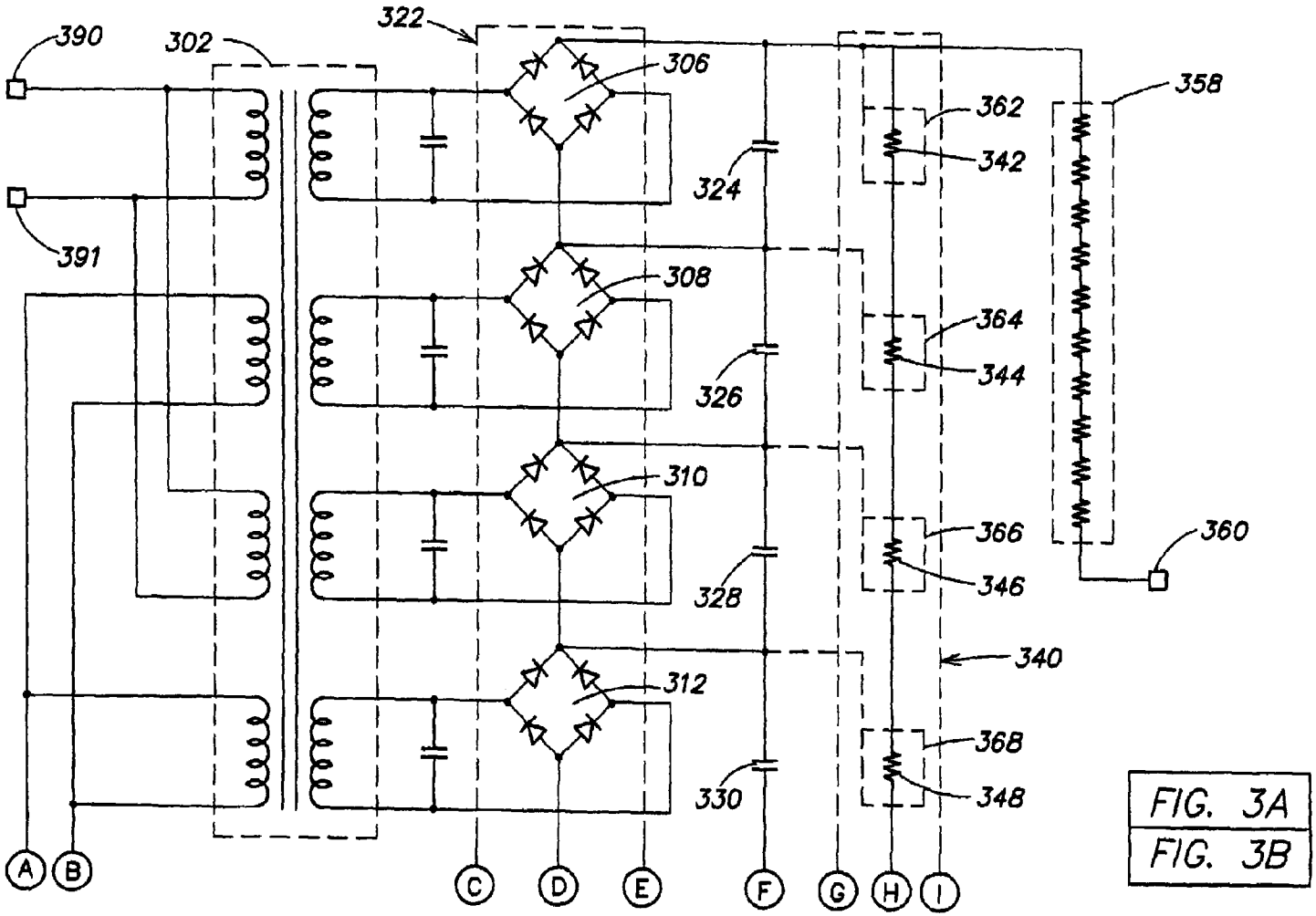
FIGS. 3A and 3B show schematic diagrams of the cathode/anode high-voltage section of the system of FIG. 2.
Figure 3B:
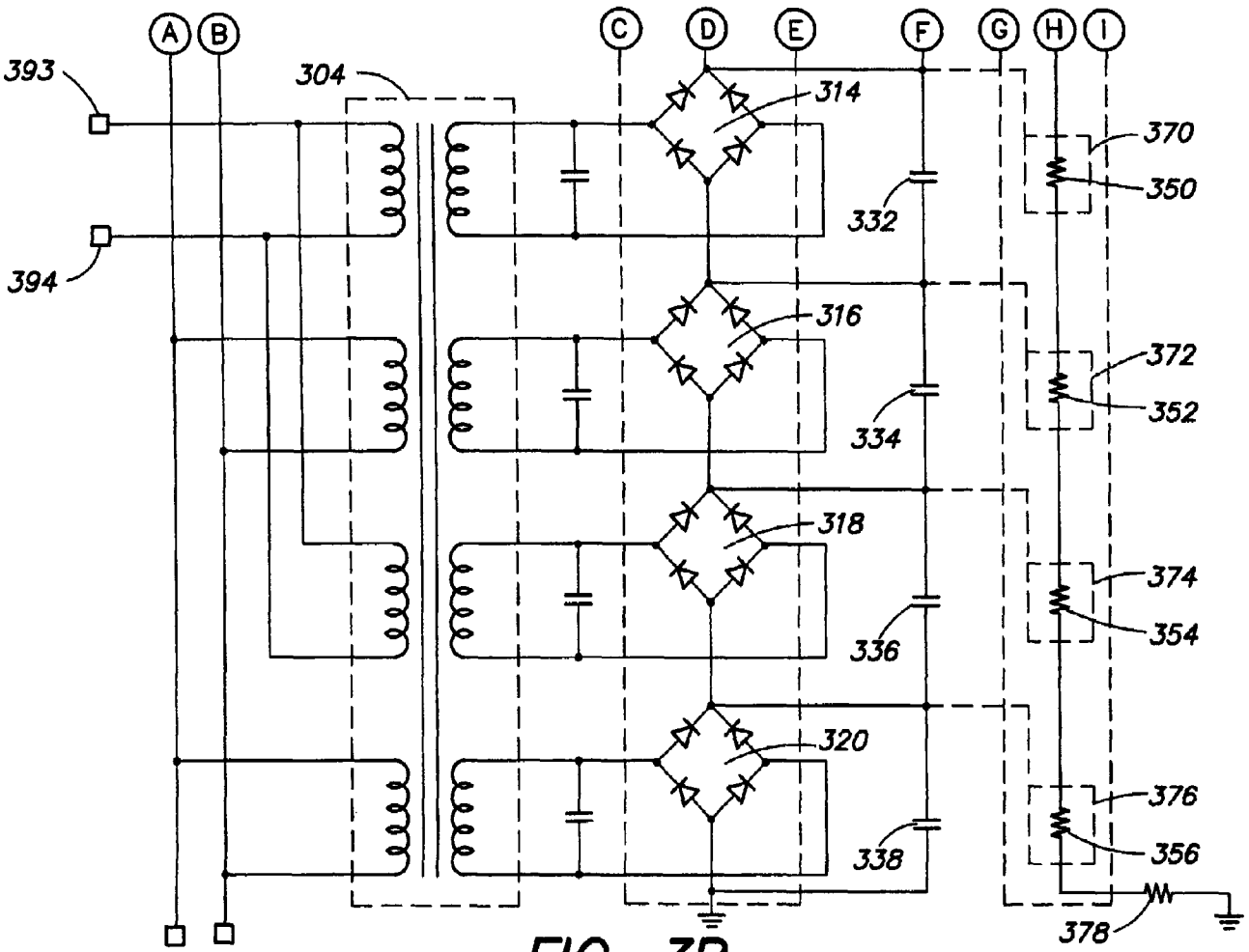

FIG. 3, shown as FIGS. 3A and 3B, is an embodiment of high-voltage module of the present invention. The high-voltage module is coupled to two MVHF inverter modules and supplies a positive DC operating current to the anode 115 of X-ray tube 116 (shown in FIG. 2). As shown in FIG. 3, nodes 390 and 391 are coupled to a first MVHF inverter module and nodes 393 and 394 are coupled to a second MVHF inverter module. The high-voltage module comprises two high-frequency transformers 302 and 304. The first high-frequency transformer coupled to four high-voltage rectifier bridges (306-12) and the second high-frequency transformer coupled to another four high-voltage rectifier bridges (314-320). It should be understood that the scope of the invention should not be limited to four inverter modules. The eight high-voltage rectifier bridges are coupled in series to create a high-voltage rectifier stack 322, wherein each high-voltage rectifier bridge is further coupled to a filter capacitor (324-338). The high-voltage rectifier stack is further coupled, in series, to a high-voltage divider 340 comprising eight resistors 342-356. It should be appreciated that the number of resistor corresponds to the number of high-voltage rectifiers, therefore the scope of the invention should not be limited to eight high-voltage rectifiers or eight resistors in the high-voltage divider. The high-voltage divider 340 is further coupled to an arc-protection circuit 358.

A first alternating current (AC) current from a first MVHF inverter module flows through a first primary winding and a second primary winding of the high-frequency transformer 302. The magnetic coupling between a first primary winding of high-frequency transformer 302 and a first secondary winding and a second primary winding and a second secondary winding of the high-frequency transformer 302 provides a second AC current corresponding to the first AC current in each of the two secondary windings. The second AC currents in each of the two secondary windings are coupled through coupling capacitors, which are coupled in parallel with the two secondary windings, to two high-voltage rectifier bridges each coupled to one of the two secondary windings. The AC currents are converted to DC currents by the high-voltage rectifier bridges 306-320 and the DC currents are filtered by the filter capacitors 324-338. As the DC currents flow through the high-voltage divider 340, a voltage is generated across each of the resistors 342-356 of the high-voltage divider. This DC voltage is coupled through an arc-protection circuit 358 and is coupled through node 360 to the anode 115 of the X-ray tube 116.

The anode and cathode high-voltage sections are identical, except that the anode high-voltage section provides a positive high-voltage to the X-ray tube anode, while the cathode high-voltage section provides a negative high-voltage to the X-ray tube cathode, and includes a filament drive transformer 244 (shown in FIG. 2).

The rectifier stack is comprised of four identical full wave rectifiers. Each tripler rectifier is composed of three full wave, four diode bridges with an output filter capacitor across DC output of each bridge. The DC outputs of all 16 total, 8 anode, 8 cathode, bridges are coupled in parallel. The AC input of the four transformers are all are coupled in parallel. A capacitor (resonant capacitance C) is connected across each transformer secondary windings (16 in total).

The bridges are assembled from 68 high-voltage rectifier diodes with ratings of 400 milliampere average forward current and eight kilovolts reverse blocking voltage. The 16 resonant capacitors are 15 picofarad, 10 kilovolts, film capacitors. The 16 output filter capacitors are 10 nanofarad, 10 kilovolts, film capacitors.

This HV module arrangement provides up to 75 kilovolts positive to the anode of the X-ray tube, and 75 kilovolts negative to the cathode with reversed diode pluralities.

High-Voltage Divider

The high-voltage divider 340 is comprised of 8, 20 megaohm resistors coupled in series for both the anode and cathode modules. The DC current coupled through the high-voltage divider is then about 0.3 milliamperes at 75 kilovolts. The 16 resistors are assembled along side the 16 stage high-voltage rectifier stack and close to the 16 filter capacitors. The whole rectifier filter divider assembly is sandwiched between two circuit boards where large traces are connected to potential taps between each multiplier stage. This topology guards each resistor of the precision divider at the proper potential without requiring any other component, and thus, ensuring fast pulse response.

The resistor series of the high-voltage divider 340 corresponds to the high-voltage rectifier stack, that is, the ratio of the number of resistors in the high-voltage divider to the number of the high-voltage rectifiers is one to one. As shown schematically in FIG. 9A, the high-voltage rectifier stack has a plurality of multiplication modules I, II . . . N, each multiplication module having an AC input and a DC output, wherein the AC inputs of the multiplication modules are connected in parallel, and the DC outputs of the multiplication modules are connected in series. The parallel connections of the multiplication modules may be through at least one coupling voltage limiting device. The plurality of multiplication modules may comprise an output filter voltage limiting device across each DC output of the multiplication modules, as shown in FIGS. 3A and 3B. The capacitance of the coupling voltage limiting devices may be at least less than a capacitance of the output filter voltage limiting devices connected across the DC outputs of the multiplication modules connected in parallel.

According to an aspect of the present invention, a spatial arrangement of two circuit boards, the high-voltage rectifier stack, the high-voltage divider and the filter capacitors, provides voltage compensation for each resistor of the high-voltage divider by forming a substantially complete Faraday Cage about each resistor of the high-voltage divider.

Figure 9:
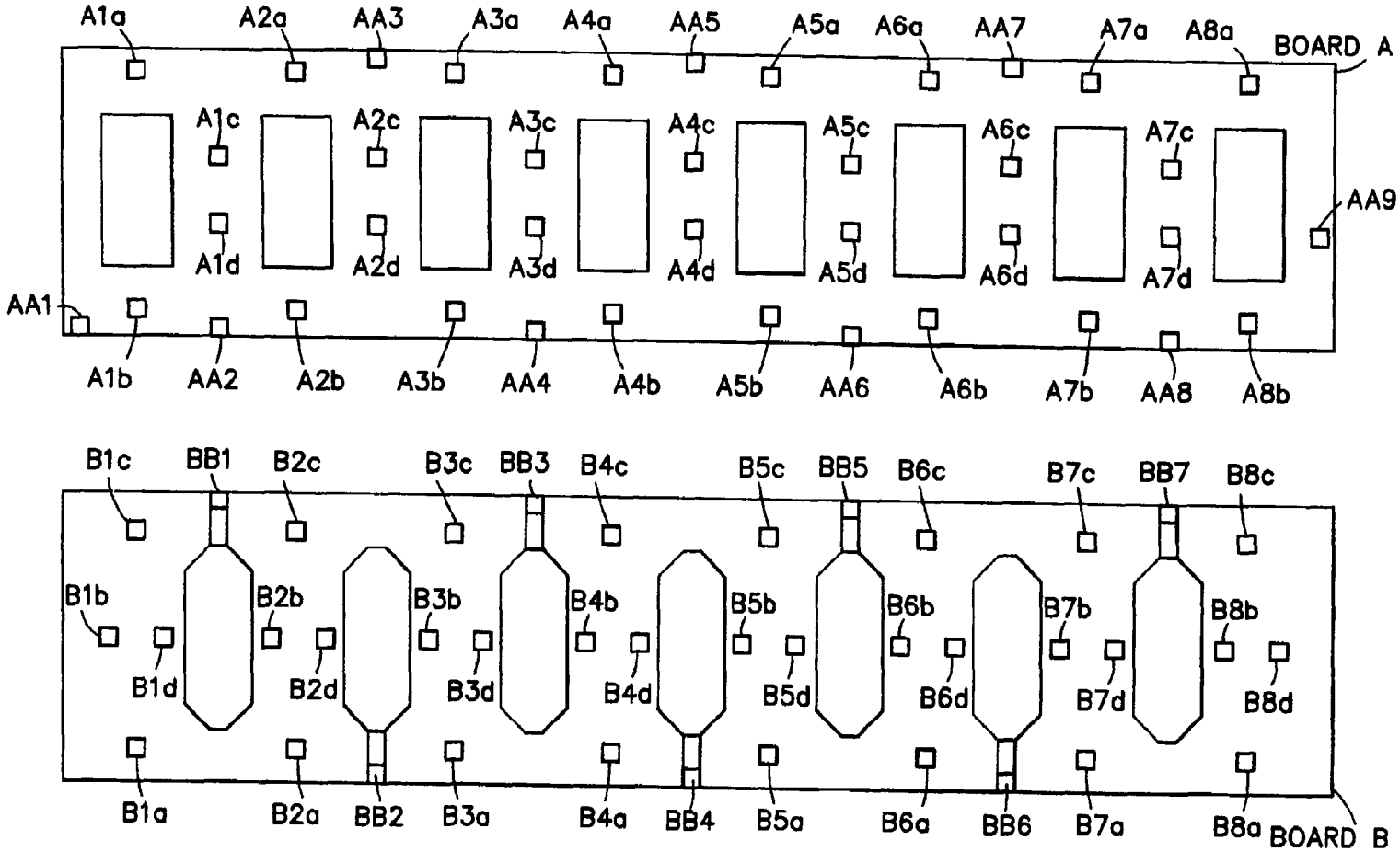
FIG. 9 is a schematic diagram of the shielded resistor divider in accordance with one embodiment of the invention, showing top plan views of the first and second boards.
Figure 9A:
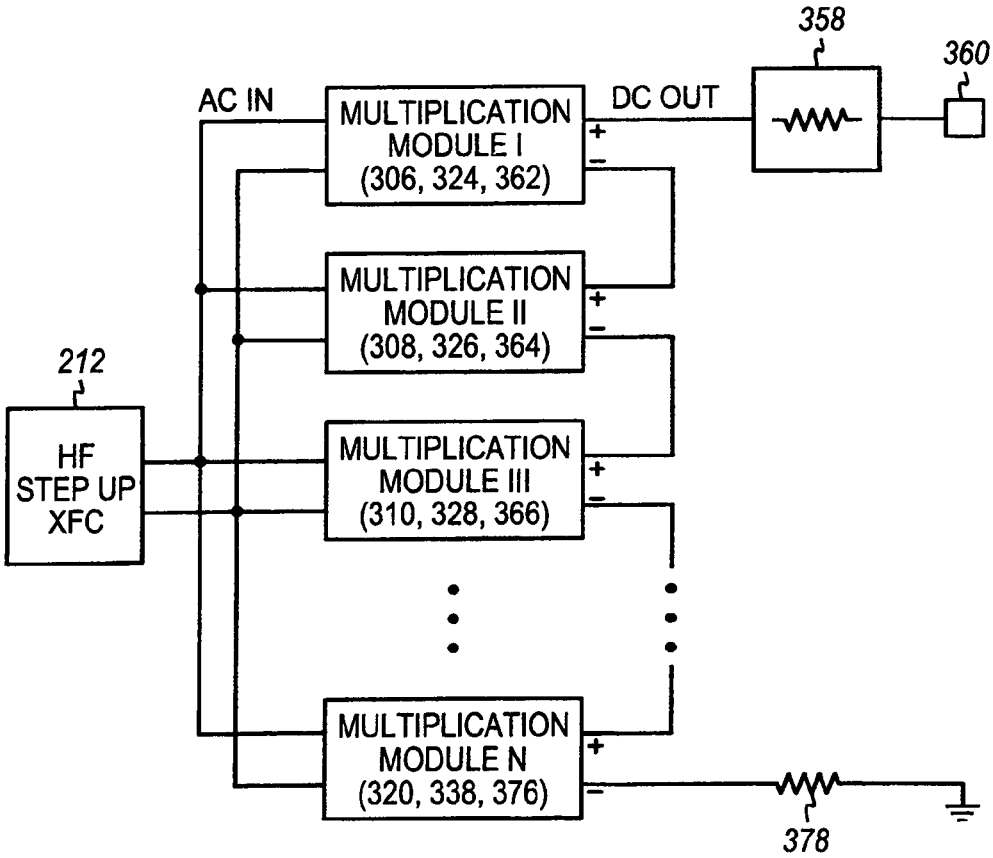
FIG. 9A shows schematically a plurality of multiplication modules having an AC input and a DC output.

According to an aspect of the present invention shown in FIG. 9, the spatial arrangement of the high-voltage rectifier stack, the filter capacitors, and the high-voltage divider comprises a first capacitor of the filter capacitors coupled across mount holes A1*a* and A1*b* on Board A; a second capacitor coupled across mount holes A2*a* and A2*b*; a third capacitor coupled across mount holes A3*a* and A3*b*; a fourth capacitor coupled across mount holes A4*a* and A4*b*; a fifth capacitor coupled across mount holes A5*a* and A5*b*; a sixth capacitor coupled across mount holes A6*a* and A6*b*; a seventh capacitor coupled across mount holes A7*a* and A7*b*; an eighth capacitor coupled across mount holes A8*a* and A8*b*; a first diode bridge of the high-voltage rectifier stack coupled across mount holes B1*a*, B1*b*, B1*c*, and B1*d*; a second diode bridge coupled across mount holes B2*a*, B2*b*, B2*c*, and B2*d*; a third diode bridge coupled across mount holes B3*a*, B3*b*, B3*c*, and B3*d*; a fourth diode bridge coupled across mount holes B4*a*, B4*b*, B4*c*, and B4*d*; a fifth diode bridge coupled across mount holes B5*a*, B5*b*, B5*c*, and B5*d*; a sixth diode bridge coupled across mount holes B6*a*, B6*b*, B6*c*, and B6*d*; a seventh diode bridge coupled across mount holes B7*a*, B7*b*, B7*c*, and B7*d*; an eighth diode bridge coupled across mount holes B8*a*, B8*b*, B8*c*, and B8*d*; a first resistor of the high-voltage divider coupled across mount holes A1*c* and A1*d*; a second resistor coupled across mount holes A2*c* and A2*d*; a third resistor coupled across mount holes A3*c* and A3*d*; a fourth resistor coupled across mount holes A4*c* and A4*d*; a fifth resistor coupled across mount holes A5*c* and A5*d*; a sixth resistor coupled across mount holes A6*c* and A6*d*; a seventh resistor coupled across mount holes A7*c* and A7*d*; an eighth resistor coupled across mount holes A8*c* and A8*d*; the eight resistors are in series by electrically coupling mount holes AA1 to A1*c*, A1*d* to A2*c*, A2*d* to A3*c*, A3*d* to A4*c*, A4*d* to A5*c*, A5*d* to A6*c*, A6*d* to A7*c*, A7*d* to A8*c*, and A8*d* to AA9; forming the substantially complete Faraday Cage by electrically coupling mount holes A1*b* to B1*c*; A2*b* to B2*c*; A3*b* to B3*c*; A4*b* to B4*c*; A5*b* to B5*c*; A6*b* to B6*c*; A7*b* to B7*c*; A8*b* to B8*c*; and by electrically coupling potential tap at BB1 to AA2; potential tap at BB2 to AA3; potential tap at BB3 to AA4; potential tap at BB4 to A5; potential tap at BB5 to AA6; potential tap at BB6 to AA7.

Arc Protection Circuit

As shown in FIG. 3, arc protection circuit 358 is coupled between the high-voltage divider 340 and a load coupling at node 360. The inventor discovered that a classical arc protection mechanism using a lossy inductor can be replaced by a plurality of resistive elements coupled in series. In an embodiment of the present invention, ten 50-ohm, 10 Watt resistors are coupled in series, each resistor having five micro-henries of stray inductance. This resistor series functions as an equivalent inductor with an inductance of 50 micro henries, and a series resistance of 500 ohms. It should be appreciated that the number of resistors used in the art protection circuit 358 corresponds to a predetermined resonant property of the arc protection circuit, therefore the scope of the invention should not be limited to 10 resistors.

The equivalent inductance of the arc protection circuit 358 prolongs the rise time of a fault current, and the equivalent resistance damps a reflected energy from a load. By prolonging the rise time of a fault current, fuses and a shutdown circuitry are given time to limit the fault current to a tolerable level. The equivalent resistance also prevents a ringing, or a resonance between the high-voltage cable and the equivalent capacitance of the high-voltage generator output.

While eliminating the need for a costly and bulky inductor, the Arc Protection Circuit described above has been demonstrated to provide full protection against one-shot and recurring tube arcs, which are independent from the transmission line effects of the high-voltage coaxial cables.

Low-Voltage Section

Low-Voltage DC Supply

Figure 4:
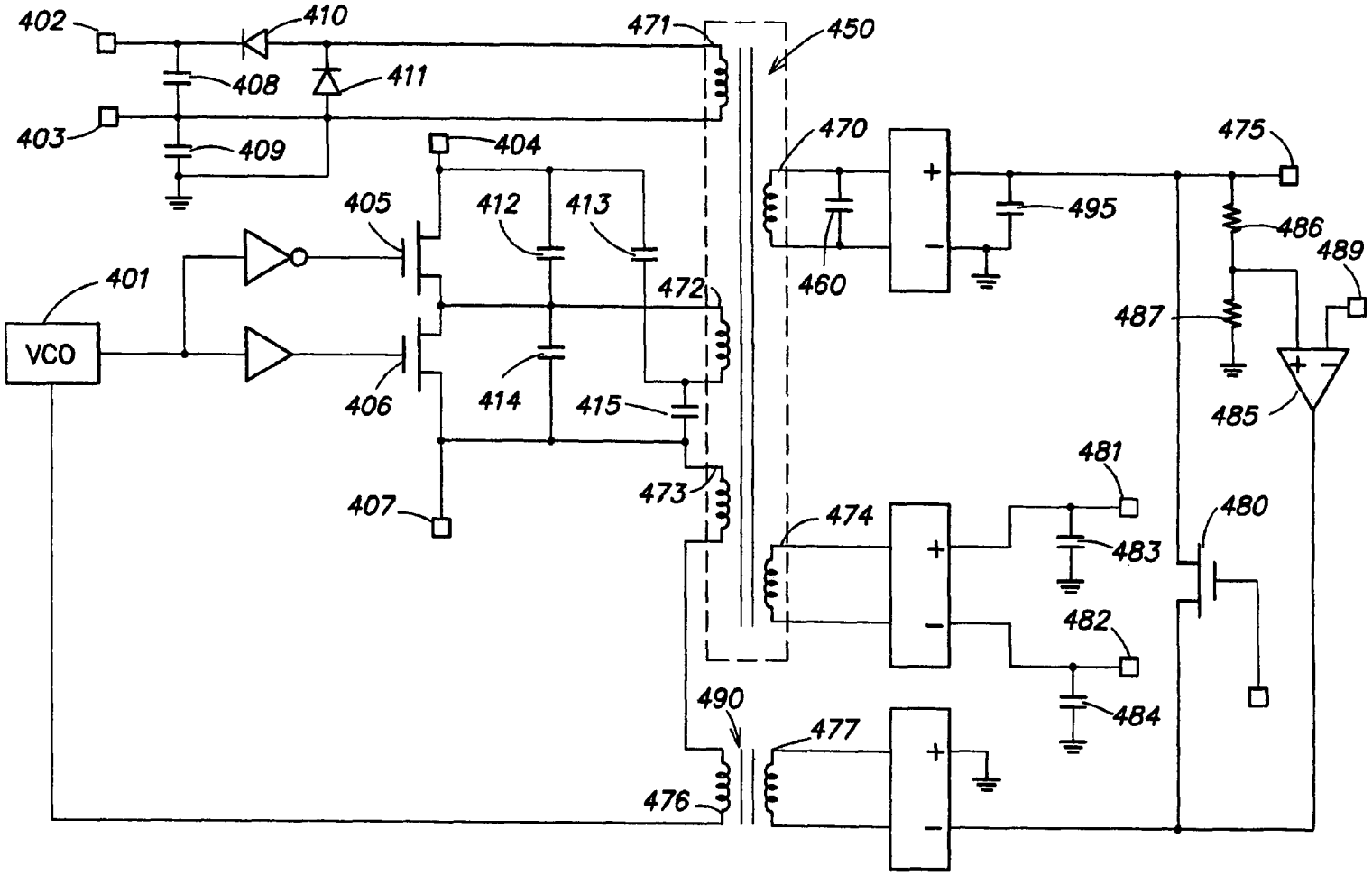
FIG. 4 is a schematic diagram of a low-voltage DC supply used in system of FIG. 2.

Referring to FIG. 4, the low-voltage DC supply comprises an HP inverter, a VCO, a transformer coupling an output of the HF inverter to an X-ray tube filament driver and a fault detection circuit.

The HF Inverter comprises a resonant circuit that includes a leakage inductance of the transformer 450, and a resonance capacitance 460 across a secondary 470 of the transformer 450. The HF inverter further comprises a switching circuit comprising a first IGBT 405 and a second IGBT 406. The secondaries 470 and 474 are respectively connected to rectifier bridges. The output of the bridges gives the supply voltages 475, 481, 482. Supply voltage 475 is typically 180 V DC and supply voltage 481 and 482 are typically +24 V DC and −24 V DC, respectively. Resistors 486 and 487 form the output divider connected to an amplifier 485, which is an error amplifier arranged to shift the frequency of VCO 401 depending on the load.

The frequency of the VCO is determined by the reflected impedance of a transformer 490. This impedance is in series with a primary winding 473. Varying the impedance will therefore give a variable voltage to the VCO input, controlling the frequency, a low impedance of winding 476 will give the highest frequency, and therefore the lowest power output.

Tube Filament Supply

Figure 8:
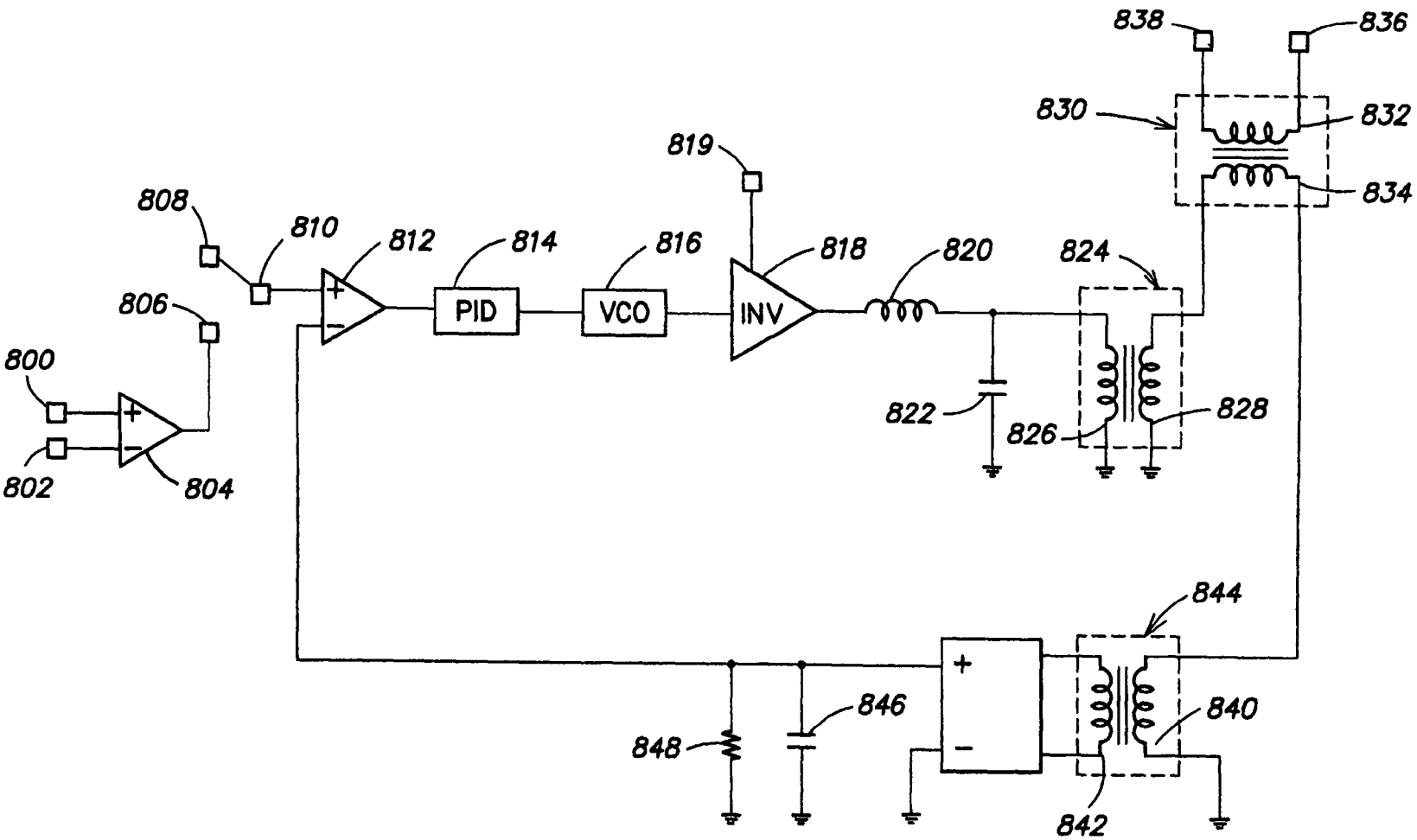
FIG. 8 is a schematic of a low-voltage filament supply used in system of FIG. 2.

A tube-filament supply shown in FIG. 8 provides high frequency AC power to an X-ray tube filament through a filament transformer 830.

The filament supply voltage is generated by a resonant HF Inverter 818. The HF Inverter 818 is supplied with 180 volts DC by the low-voltage DC supply at node 819. The tube-filament supply also comprises a resonant circuit which comprises a leakage inductance 820, a filament drive transformer 824 and a capacitance 822 coupled across a primary winding 826 of the filament drive transformer 824. The secondary winding 828 of the filament drive transformer 824 couples to a primary winding 834 of a filament transformer-current transformer 830, whose secondary winding 834 couples to a cathode filament of an X-ray tube at nodes 838 and 836. The secondary winding 828 coupled to primary winding 834 further couples to a primary winding 840 of a current transformer 844, whose secondary winding 842 couples to the error amplifier 812.

Voltage Control Feedback Loop

In an embodiment of the present invention, an operational amplifier circuit implements a proportional-integral-derivative (PID) 814 arranged in a high-voltage control loop to provide a control mechanism for VCO circuit 816. According one aspect of the invention, an integration circuit and a derivation circuit comprises RC circuits associated with the operational amplifier circuit. A controller 812 compares a predetermined voltage to an actual voltage and outputs a control voltage to the VCO 810 that is proportional to a difference between the two voltages and a derivative and an integral term. There is a single predetermined voltage for the total anode-to-cathode voltage. The actual voltage can be obtained by a summing measurement of the anode and cathode voltages (shown in FIG. 2) via sampling resistors coupled between the high-voltage divider 340 and then ground; and summing the voltages via operational amplifiers.

Power Supply System for use in a Computed Tomography System

Figure 14:
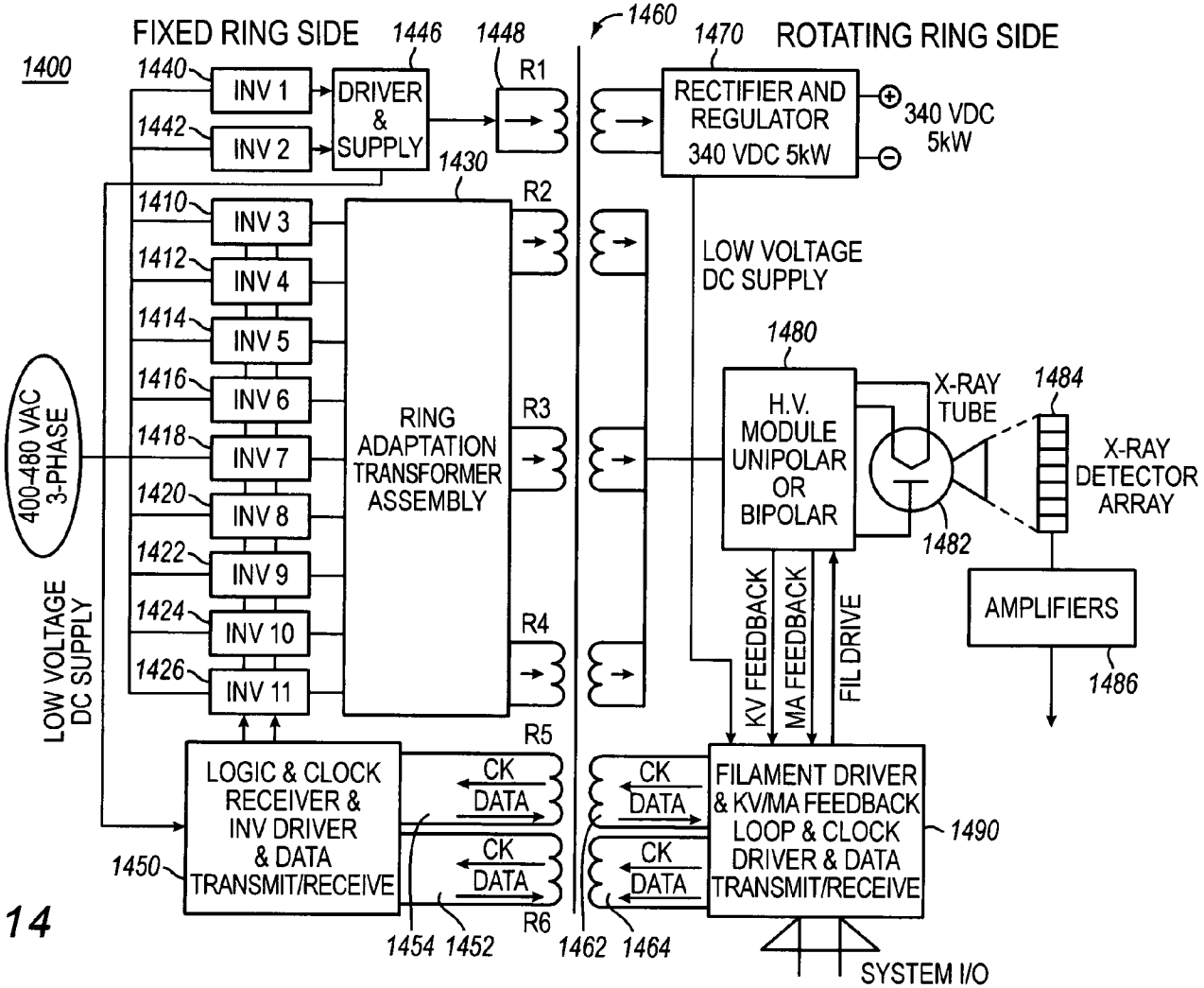
FIG. 14 illustrates diagrammatically an embodiment of a high-voltage power supply system for use in a computed tomography system.

FIG. 14 illustrates a high-voltage power supply system 1400 for use in a computed tomography system. High-voltage power supply system 1400 includes a ring transformer 1460 having the primary, stationary side coupled to a set of power inverters 1440, 1442 coupled to a driver supply 1446. The secondary rotating side of ring transformer 1460 is coupled to a rectifier and regulator 1470 shown in FIG. 18. The primary, stationary side of ring transformer 1460 is also coupled to a ring adaptation transformer assembly 1430, described in detail in FIG. 14A, coupled to a set of inverters 1410, 1412, 1416, 1418, 1420, 1422, 1424, and 1226, all of which are described above. Inverters 1410, 1412, 1416, 1418, 1420, 1422, 1424, and 1226 are controlled by a stationary controller 1450. Stationary controller 1450 is coupled to a rotational controller 1490 using the ring transformer and a stationary adaptation circuitry 1452, 1454, and a rotational adaptation circuitry 1462, 1464.

Various embodiments of the ring transformer are described in U.S. Pat. Nos. 4,912,735; 5,608,771; 6,674,836; and 7,054,411 all of which are incorporated by reference as if fully reproduced herein.

Figure 14A:
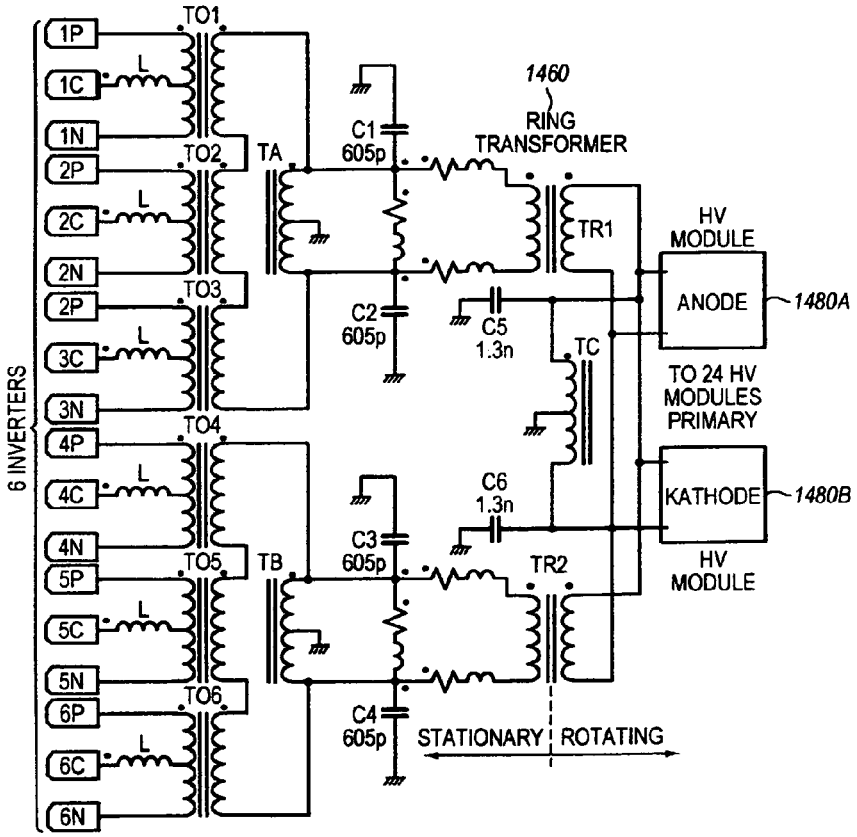
FIG. 14A illustrates an adaptation transformer assembly cooperatively designed with a ring transformer for use in the high-voltage power supply system of FIG. 14.

FIG. 14A illustrates an adaptation transformer assembly including secondary windings of the intermediary transformers that may be split into several banks. The primaries of the ring power transformer are in center tap (CT) configuration and grounded. This eliminates common mode voltages and consequent ground currents through parasitic capacitances.

The primary of the intermediary transformers T01-T06, are split in center tap configuration as well. The center tap point is connected to an inductor L (FIG. 14A) that in turns connects to the mid-point between +DC and −DC where +DC and −DC is the power input to the inverters. This is represented in FIG. 7 where P1, P3, P2 correspond to 1P, 1N and the mid-point 1C in FIG. 14A. The function of this inductor is as follows. During regular operation at relatively high power loads, both sides of the inductor L are static so that the average voltage across L is zero and no current is generated in L. Thus, at higher power levels L does not influence operation. At relatively low power loads, not enough inverter primary current exists (due to the higher frequency of operation under this condition) to discharge the power snubber capacitors SC1-SC4 (FIG. 7) effectively. This would cause severe overheating of the power semiconductor devices Q1-Q4 and possible failure. To resolve this problem, when the control commands a frequency above a determined value, regulation for decreasing power loads is achieved using phase-shift modulation in addition to frequency modulation, whereby Q1 and Q2, or Q3 and Q4 are allowed to conduct at the same time during the switching cycle. While this reduces the power output effectively to provide regulation, the necessary current needed to discharge the snubber capacitors becomes otherwise increasingly unavailable. However, with phase modulation, the voltage across added inductor L becomes important so that significant currents are now developed. This added current (produced only at lower power loads as mentioned) provides enough discharge drive for the snubber capacitors allowing overall safe and efficient operation.

Figure 21A:
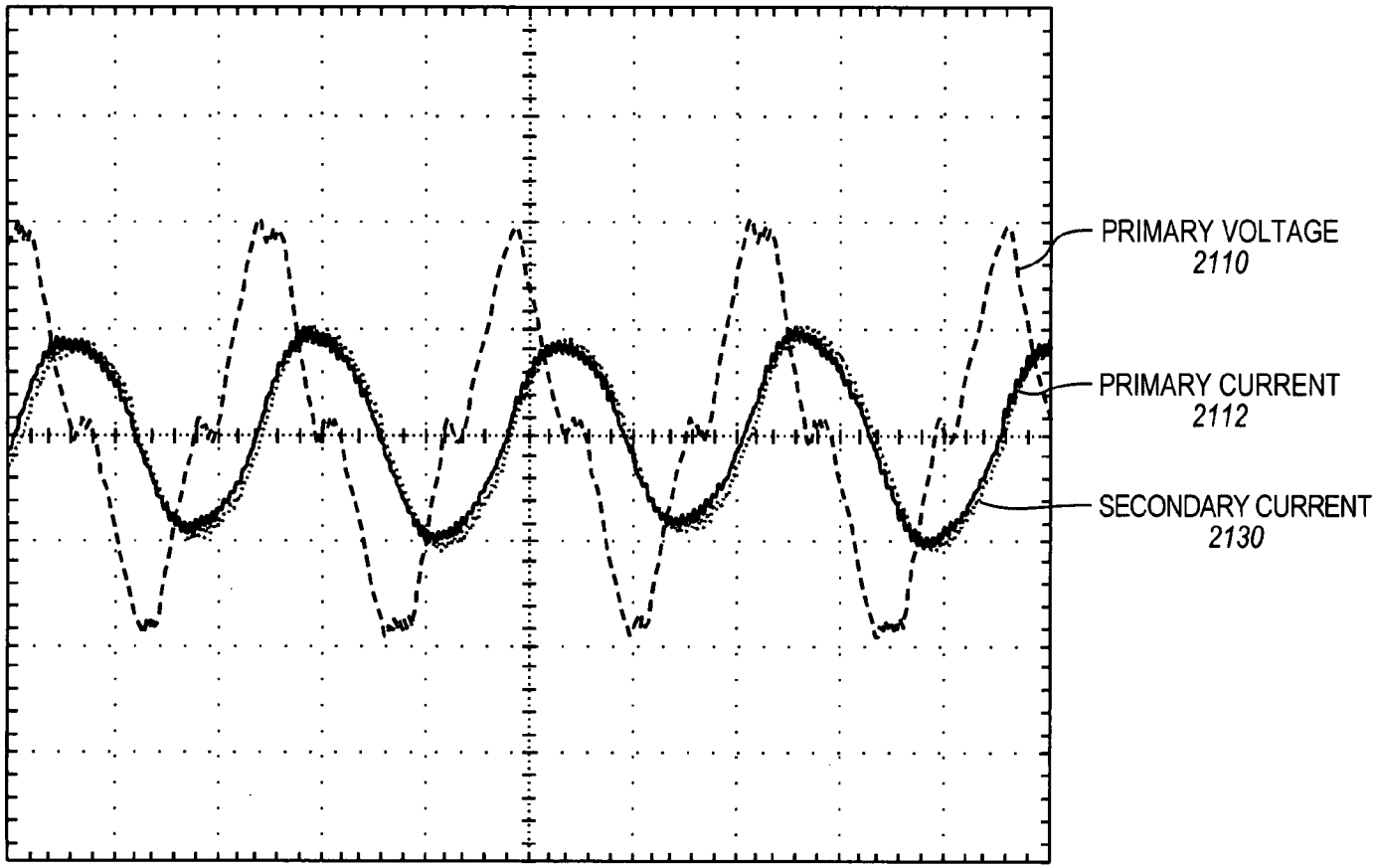
FIG. 21A shows current and voltage time-dependent curves for a primary and secondary generated by two inverter signals phases-shifted 180 degrees.

Operation under phase-shift regime is demonstrated through comparison of to FIG. 21A. showing the power waveforms on the primary and secondary of the ring transformer. For FIGS. 21B, 21C, 21D the voltage waveform is near-rectangular with no dead-time (dead-time is defined as a time interval during which the waveform has near-zero value). This shows no phase shift operation, however, the waveforms have higher frequencies as the load diminishes. At around 100 kHz phase-shift begins.

FIG. 21A shows operation at 107.8 kHz where phase shift is 70 deg. This type of operation is characterized by the appearance of dead-time in the voltage waveform that causes a reduction in the effective driving voltage. This, in turn controls output power effectively.

Figure 19:
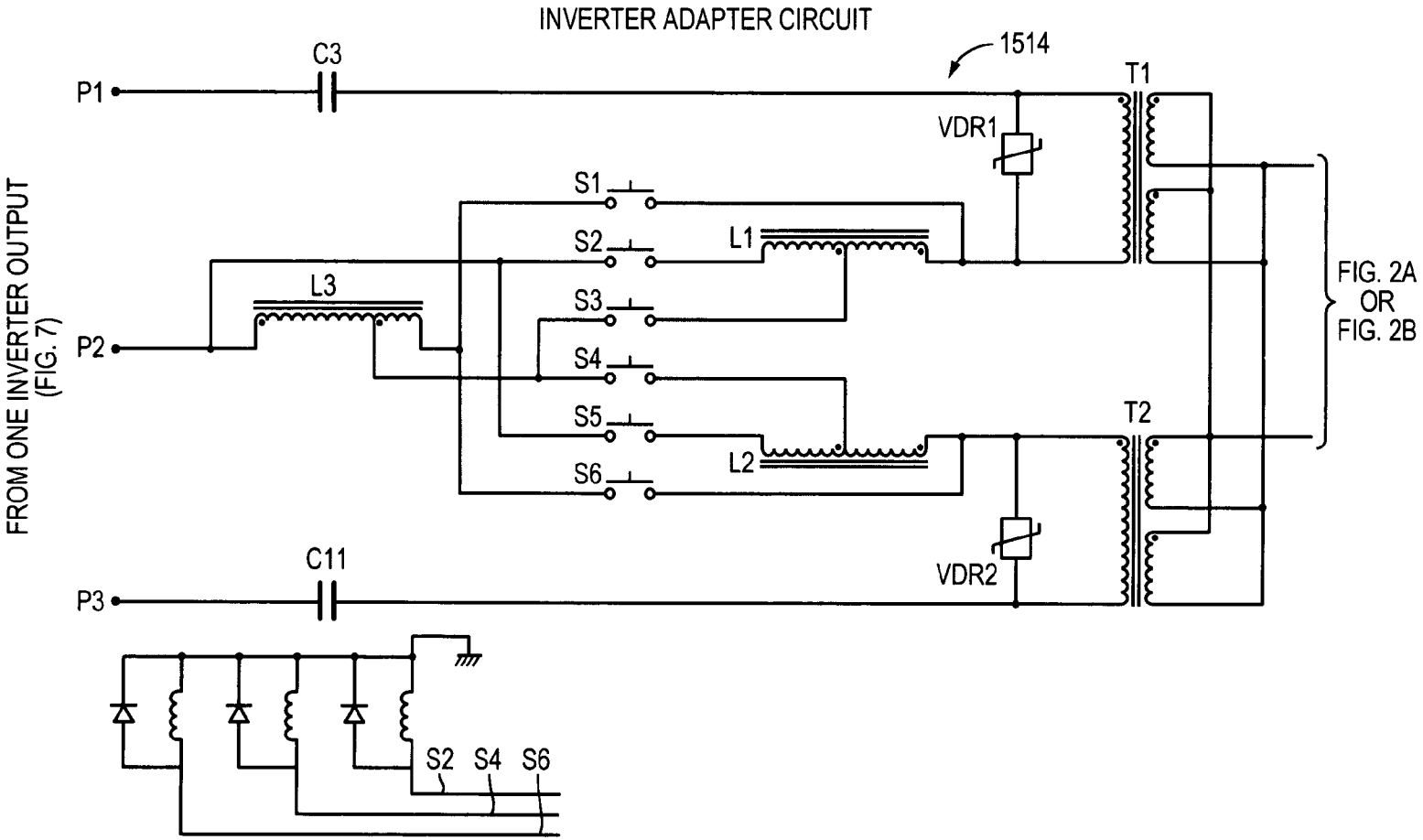
FIG. 19 illustrates schematically an inverter adaptation circuit.

FIG. 19 shows the primary side of one of the intermediary transformers. L1 and L2 are the inductors needed for resonant operation, while L3 is the added inductor described in FIG. 14A above. The significance of FIG. 19 is the presence of various relays that modify the values of these inductances by selecting different winding taps. The operation of the resonant circuit and its behavior during low-power phase-shift mode can therefore be optimized on the fly.

Figure 15:
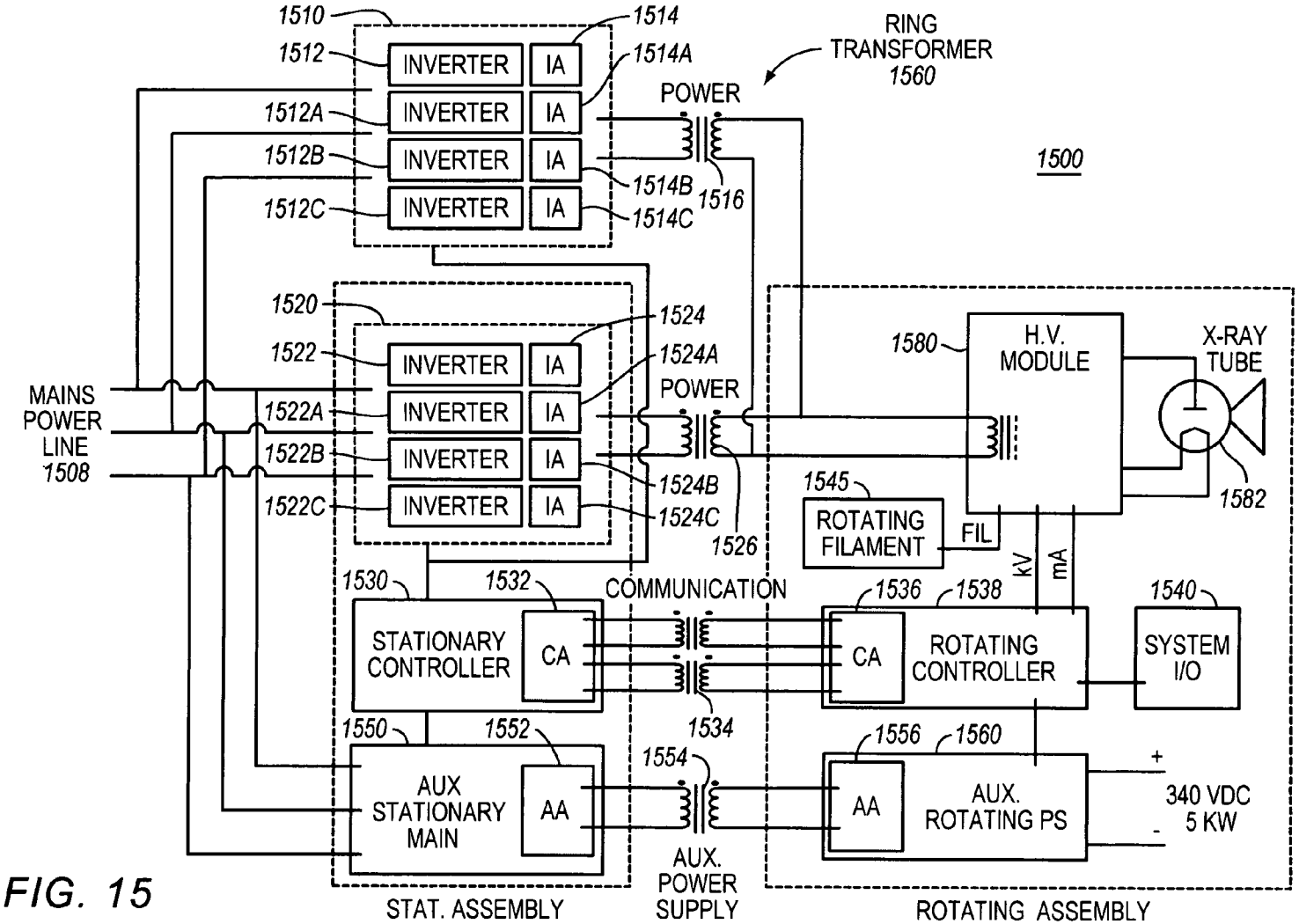
FIG. 15 illustrates diagrammatically another embodiment of a high-voltage power supply system for use in a computed tomography system.

FIG. 15 illustrates diagrammatically another embodiment of a high-voltage power supply system 1500 for use in a computed tomography system. The stationary assembly includes a stationary inverter and inverter adaptation assembly 1510, a stationary inverter and inverter adaptation assembly 1520, stationary controller and controller adaptation circuitry 1530, and a stationary auxiliary power and adaptation circuitry 1550. Stationary inverter and inverter adaptation assembly 1510 includes inverter 1512 coupled to inverter adaptation circuit 1514, inverter 1512A coupled to inverter adaptation circuit 1514A, inverter 1512B coupled to inverter adaptation circuit 1514B, inverter 1512C coupled to inverter adaptation circuit 1514C. Stationary inverter and inverter adaptation assembly 1520 includes inverter 1522 coupled to inverter adaptation circuit 1524, inverter 1522A coupled to inverter adaptation circuit 1524A, inverter 1522B coupled to inverter adaptation circuit 1524B, inverter 1522C coupled to inverter adaptation circuit 1524C. Ring transformer 1560 includes a power transformers 1516 and 1526 each including the stationary side and the rotational side.

The main power coils of transformers 1516 and 1526 pass the desired power at high frequency with low losses. A typical one coil pair of rotating and stationary coils handles 40-80 kW intermittent power. Those coils have high ratio of LM/LL (magnetizing inductance versus leakage inductance) generally depending on the gap between the ferrites and the magnetic area.

Ring transformer 1560 also includes an auxilliary power transformer 1554 having coils with similar properties as mentioned above and these coils are generally expected to handle 5 kW continuous.

Figure 20:
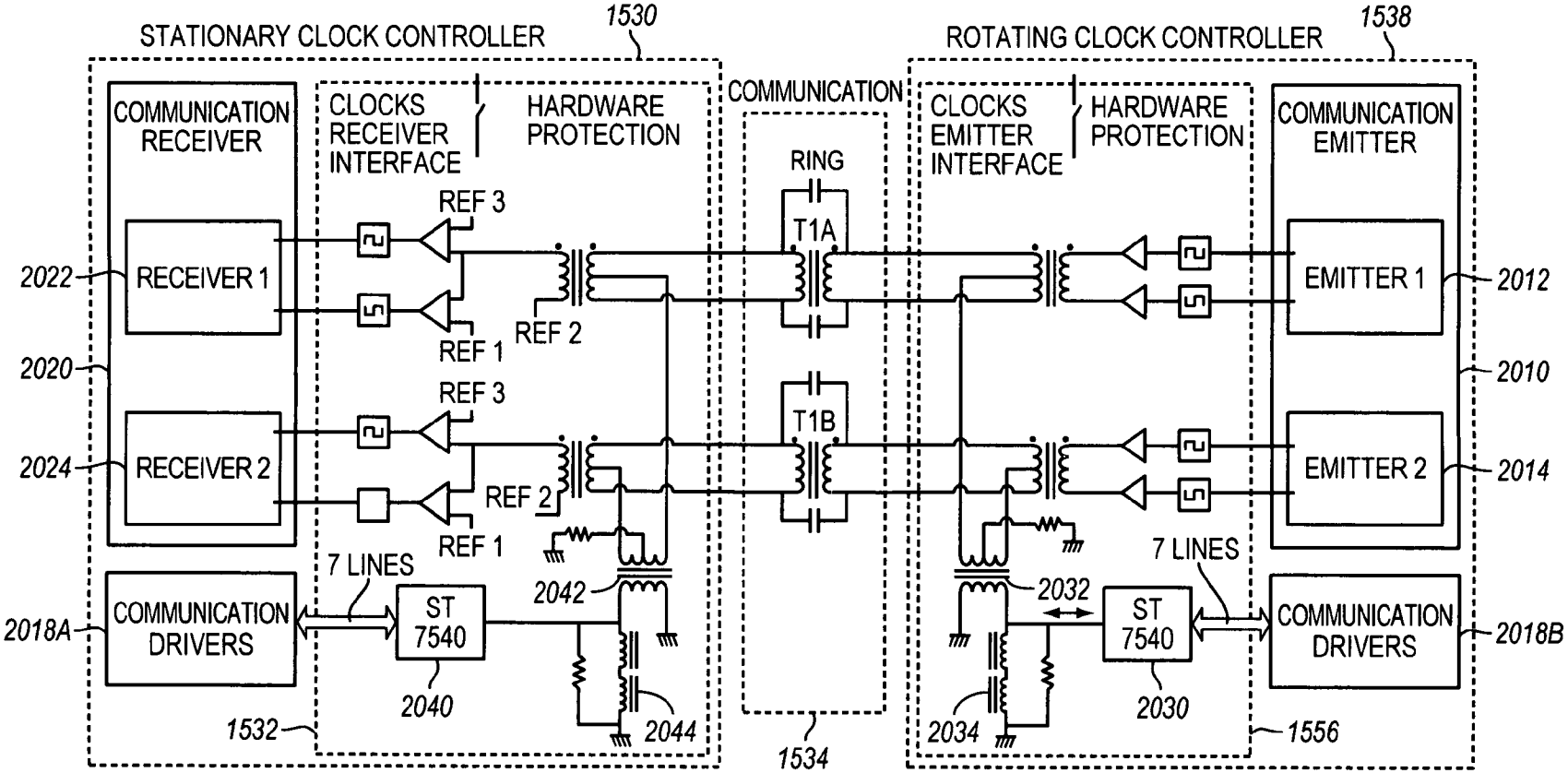
FIG. 20 illustrates schematically a stationary and a rotating controllers coupled by a ring transformer for bi-directional communication.

Ring transformer 1560 also includes a bidirectional communication transformer 1534 having clock & communication coils shown in FIG. 20. These coils are used in two ways: (1) The magnetic coupling between them is used to pass the clocks signals. The power level for those is low (approximately 1-10 watts) and frequency is typically 40-120 kHz.

(2) The capacitive coupling between the wires (stationary wires and rotating wires) is used to pass the communication carrier at approximately 100-200 kHz. The entire system is shown in FIG. 20.

Figure 16:
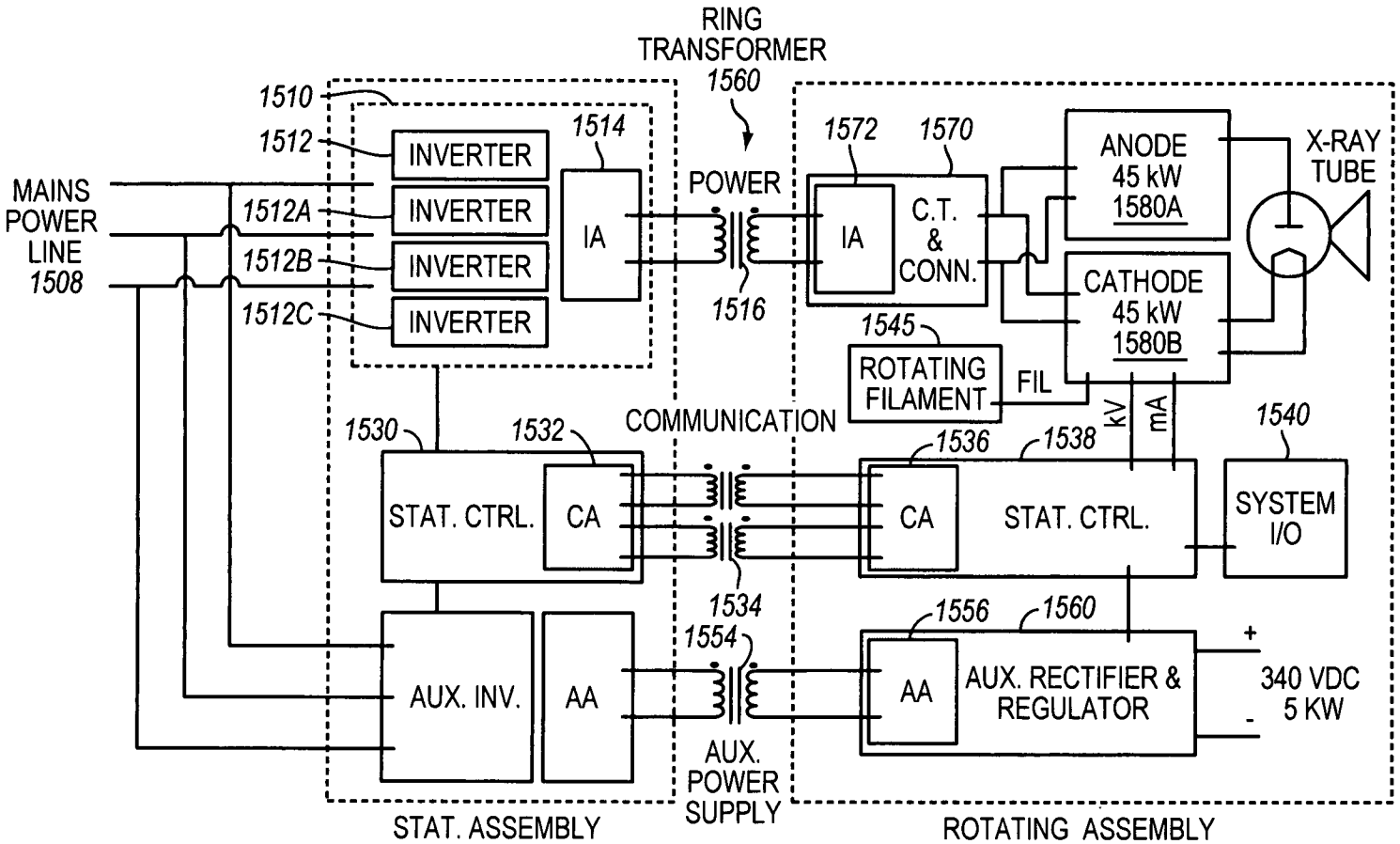
FIG. 16 illustrates diagrammatically another embodiment of a high-voltage power supply system for use in a computed tomography system.

FIG. 16 illustrates diagrammatically another embodiment of a high-voltage power supply system for use in a computed tomography system.

Figure 16A:
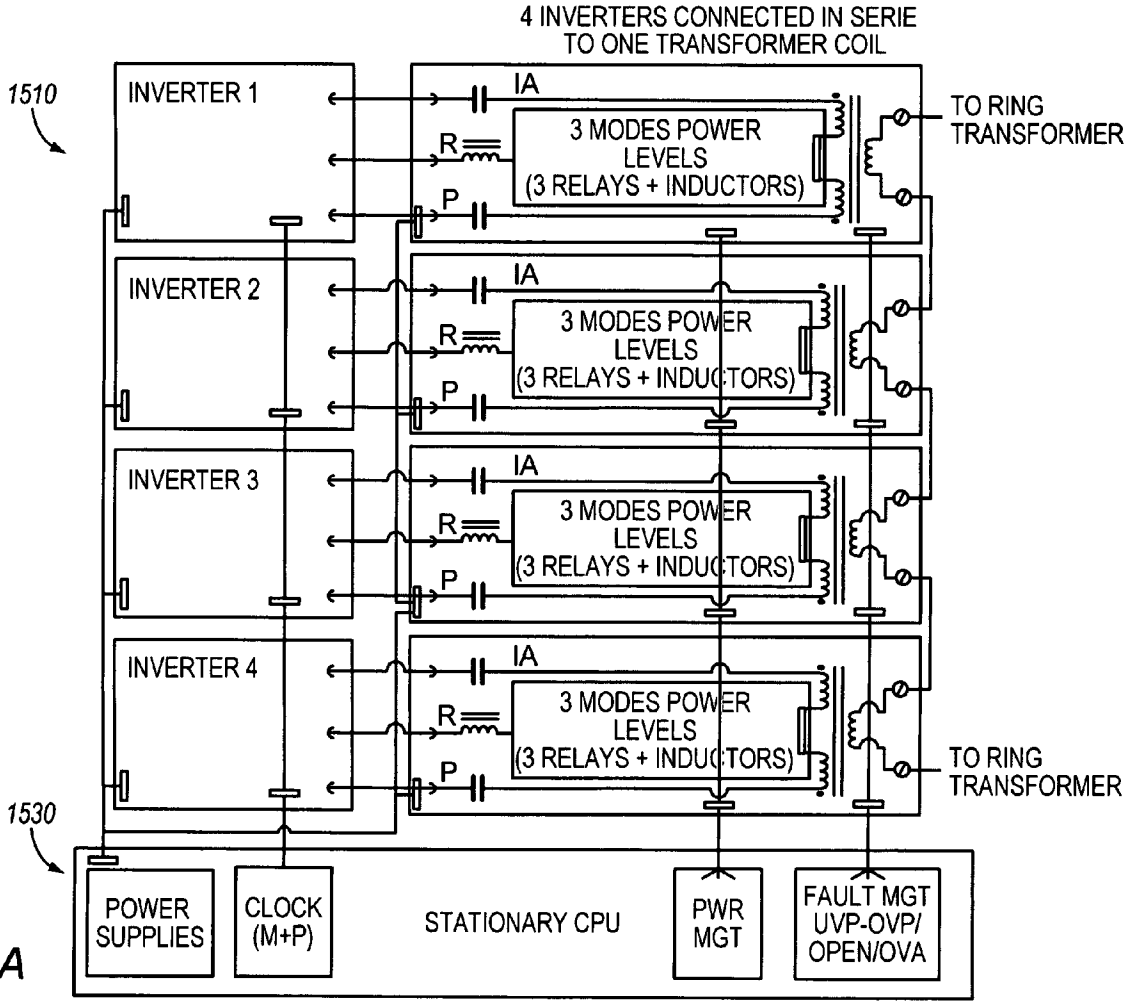
FIG. 16A illustrates diagrammatically four inverters coupled to adaptation circuits and controlled by a stationary controller of a high-voltage power supply system of FIG. 16.

FIG. 16A illustrates diagrammatically four inverters coupled to adaptation circuits and controlled by a stationary controller of a high-voltage power supply system of FIG. 16.

A power delivery system of FIGS. 14, 14A, 15 and 16 is designed to drive a rotary transformer having a primary winding and a secondary winding, the rotary transformer configured to transfer power between one or more stationary coupling elements disposed on a stationary side of the rotary transformer and one or more rotational coupling elements disposed on a rotating side of the rotary transformer, the rotational coupling elements sharing a central axis with the stationary coupling elements and being adapted to rotate with respect to the stationary coupling elements. The power delivery system includes an isolation transformer (T01-T03; T04-T06 in FIG. 14A) adapted to drive the primary winding of the rotary transformer.

The power delivery system also includes one or more power inverter stages (shown in FIG. 14, FIG. 15, and FIG. 16) configured to provide input power to the primary winding of the rotary transformer, the power inverter stages having outputs that are adapted to be summed and coupled to the isolation transformer.

The power delivery system also includes one or more output power converters configured to receive transmitted power from the rotary transformer and to convert the received power to a desired range for the rotational coupling elements. The power delivery system also includes one or more control elements disposed on the rotating side of the rotary transformer, the control elements configured to close a feedback loop on desired and actual performance of the output power converters, and further configured to provide to the stationary side of the rotary transformer one or more timing signals to control the power inverter stages (1490 in FIG. 14). The power delivery system may include plurality of power inverter stages comprise modular power inverter stages.

The plurality of power inverter stages may be disposed on the stationary side of the rotary transformer, and the plurality of output power converters are disposed on the rotating side of the rotary transformer. The plurality of power inverter stages may comprise a plurality of AC/AC conversion modules (shown in FIG. 15) configured to independently provide high frequency drive of the input power to the rotary transformer.

The plurality of AC/AC modules are configured to sum (shown in FIG. 14A) their respective outputs onto a magnetic element, and wherein the magnetic element is configured to provide a voltage centered (T01-T03; T04-T06 in FIG. 14A and voltage isolated output to the primary winding of the rotary transformer.

The control elements may include a control loop circuit configured to control delivery of power to the secondary winding of the rotary transformer, the control loop circuit disposed on the rotating side of the rotary transformer; and gate drive windings coupled to the control loop circuit and configured to receive real time gate drive waveforms from at least some of the rotational coupling elements to at least some of the power inverter stages (FIG. 14A). The rotary windings may be configured to allow for bi-directional communication between the rotational coupling elements and the stationary coupling elements, by superposition of one or more high frequency signals (shown FIG. 15 and FIG. 16).

Figure 18:
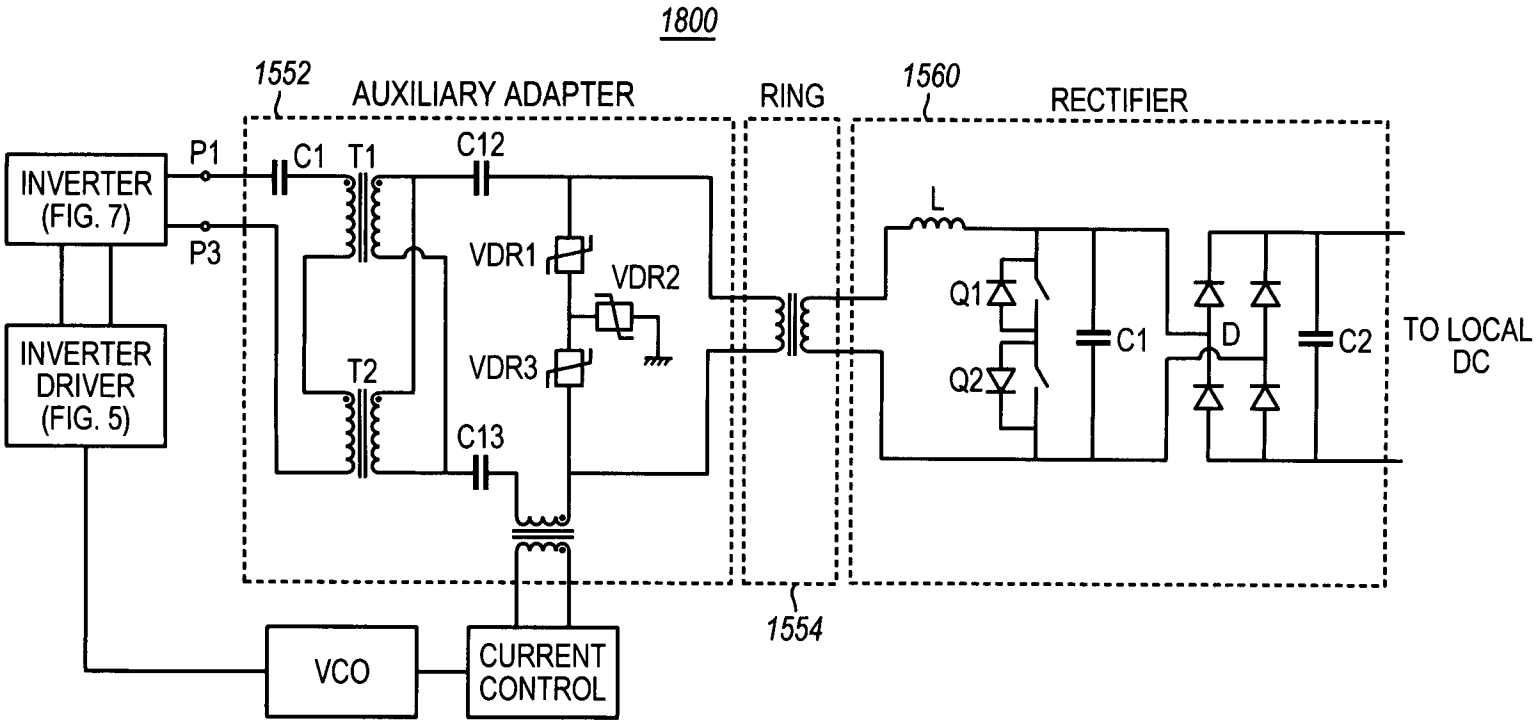
FIG. 18 illustrates schematically a controller adaptation circuit.

The power delivery system may include an auxiliary inverter disposed on the stationary side of the rotary transformer and configured to provide auxiliary power to the rotary transformer by a fixed operation of the auxiliary inverter. The power delivery system may include an auxiliary transformer (FIG. 15 and FIG. 16) having multiple windings; and an auxiliary output regulator disposed on the rotating side of the rotary transformer and configured to regulate the output locally (on the secondary side of the rotary transformer) from those auxiliary transformer windings. The power delivery system may include independent auxiliary windings in the ring transformer to provide multiple voltage outputs; and an auxiliary output regulator disposed on the rotating side of the rotary transformer and configured to regulate the output from those auxiliary windings (FIG. 18).

The windings of the rotary transformer may configured for dual use that allows for bi-directional communication through superposition of one or more coupled high-frequency modulated signals; and wherein the dual use comprises a first use in which power signals or timing signals are transmitted through the windings, and a second use that provides for bi-directional communication between the stationary side and the rotational side.

Figure 17:
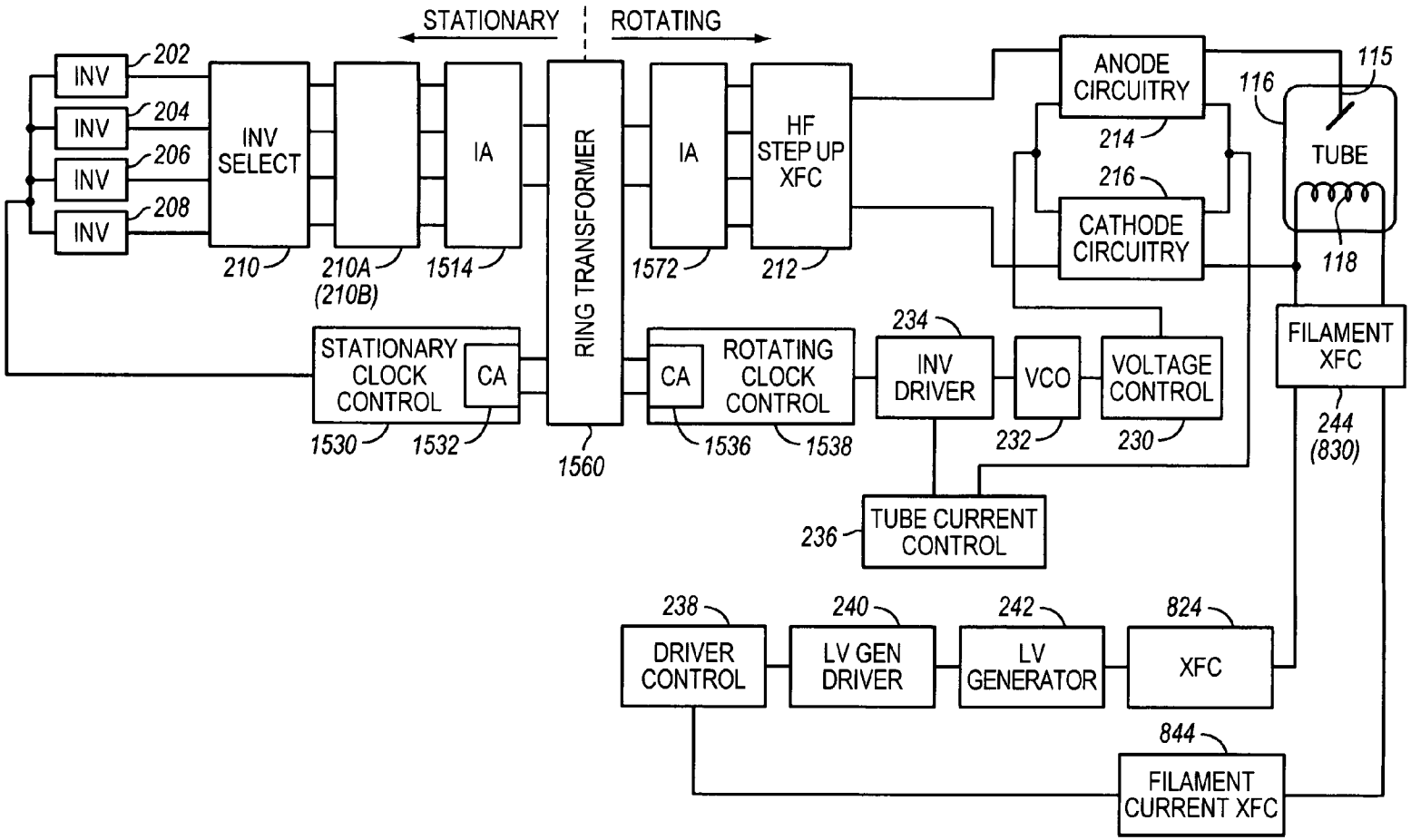
FIG. 17 illustrates diagrammatically a high-voltage power supply system of FIG. 2 modified for use in a computed tomography system.

The device for isolating one or more outputs of a power inverter system from a primary winding of a rotary transformer adapted to couple power between at least one stationary element and at least one rotational element, wherein the power inverter system is configured to provide input power to the primary winding of the rotary transformer is also shown in the figures. The device's function includes galvanic isolation between the inverters and the rotary transformer, summing several outputs of the power inverter system, facilitating system operation at very light power loads, and driving the primary winding of the rotary transformer The power delivery system designed to drive a rotary transformer having a primary winding and a secondary winding, the rotary transformer configured to transfer power between one or more stationary coupling elements disposed on a stationary side of the rotary transformer and one or more rotational coupling elements disposed on a rotating side of the rotary transformer, the rotational coupling elements sharing a central axis with the stationary coupling elements and being adapted to rotate with respect to the stationary coupling elements. The power delivery system may include an isolation transformer adapted to drive the primary winding of the rotary transformer; one or more power inverter stages configured to provide input power to the primary winding of the rotary transformer, the power inverter stages having outputs that are adapted to be summed and coupled to the isolation transformer; and one or more output power converters configured to receive transmitted power from the rotary transformer and to convert the received power to a desired range for the rotational coupling elements; and FIG. 17 illustrates diagrammatically a high-voltage power supply system of FIG. 2 modified for use in a computed tomography system. Following the appropriate selection of a number of inverters (the number depending on the desired output power and voltage—intermediary transformers are driven (T1, T2 FIG. 19, or T01-T06 is FIG. 14A). There are three added functionalities afforded by these transformers. (a) Provide basic insulation from the primary of the ring to the inverter modules. (b) Provide appropriate voltage amplification in order to properly interface with different types of rings. (c) Allow easy implementation of a series configuration for the selected inverters. This permits perfect power sharing between the inverters. This is especially true during switching transitions when driving timings may differ due to normal component tolerance variations; a series configuration forces a synchronized discharge of the ZVS (zero-voltage-switching) snubber capacitors in the inverter modules.

The secondary windings of the intermediary transformers described above may be split into several banks (shown in FIG. 16A where 4 inverters form a bank through series connection of the secondaries of the intermediary transformer. These can then drive one of several coils of the ring). This allows for more flexibility in forcing a desired power level from a set of inverters while leaving another set inactive, thus improving efficiency.

Each bank can then drive a segment or coil of the ring primary power winding.

The secondary winding of the ring feeds the High Voltage (HV) modules either directly, or through an optional step-up transformer (212) for optimal voltage and power matching.

The control circuit is on the rotating side of the ring (see FIGS. 15, 16, 17). As such, the signals necessary to drive the inverter modules on the stationary side must cross the ring. Furthermore, digital communication is needed between rotating and stationary sides. A second rotating transformer inside the ring accomplishes these tasks. The clock data is exchanged differentially via this transformer in a simple way, while the communication digital signal uses a high frequency carrier signal and the parasitic capacitance of the transformer itself. This novel concept—illustrated in FIG. 20—shows two transformers T1A and T1B, each part of the ring structure. These transformers are driven from the rotating side to the stationary side differentially to represent clock signals that are used to drive the inverters' power semiconductor devices. However, these two same transformers can also support digital communication between the two sides. When digital communication is desired, a Frequency Shift Keying (FSK) modulated signal is impressed between one winding of T1A and the corresponding winding of T1B (see 1 in FIG. 20). The signal is thus capacitively coupled through the parasitic inter-winding capacitance to the other side of the ring where it is detected in the same fashion.

Therefore, clock signals are transmitted magnetically, while digital signals are transmitted capacitively using the same transformer elements. Note that other parasitic capacitances are present in and around the transformers. Notably, these are the common-mode capacitances from the windings to the chassis grounded metal of the ring structure. In order to eliminate any interference from these capacitances, an inductor is placed in the transformer circuit (see 2 in FIG. 20) so that it resonates with the parasitic capacitor at the carrier frequency. In other words, the communication channel is tuned at the FSK frequency for improved signal discrimination.

FIG. 18 illustrates schematically a controller adaptation circuit. The Auxiliary power supply provides continuous power originating from the stationary side to the rotating side of the ring. In order to simplify the control circuit a method was conceived that would permit tight output voltage regulation without extending the feedback loop back to the stationary side. In other words, although the raw power is received from the stationary side, it is conditioned and controlled completely on the rotating side, thus improving cost, complexity and reliability.

FIG. 18 shows the system that is divided in three main parts. The first part comprises an inverter on the stationary side that produces a near-constant high frequency current source. This AC current source is obtained through the forced resonance of an inductor L and a capacitor C1 that could be placed on either sides of the ring transformer and may be discrete components or parasitics, or a combination of both.

The second part is the ring transformer that transfers the HF current to the rotating side. It also reflects any resonating components—in particular C1—to the stationary side to complete the constant HF current source mentioned above.

The third part is a shunt regulator formed by Q1 and Q2. These two switches are operated so as to short any excess resonant energy away from the output and send it back to the primary. This could aptly be called an AC shunt regulator, similar in concept to a regular DC shunt regulator, but with the advantage that excess energy is not wasted, but rather sent back to the source and recycled for much higher efficiency.

To improve efficiency further, the commutation of the switches is effected in response to a reversal of the resonant current; that is, when the current is instantaneously equal to zero during the resonant cycle. Therefore the switches commutate efficiently under Zero Current Switching (ZCS) condition.

Another advantage of the topology is the capacitive output filter C2 following the rectifying bridge D. Since C2 can be made much larger than C1, the regulated output voltage effectively clamps the AC side of D. This AC signal is therefore also regulated and can be used to drive additional outputs with excellent cross-regulation.

FIG. 19 illustrates schematically an inverter adaptation circuit discussed above.

FIG. 20 illustrates schematically a stationary and a rotating controllers coupled by a ring transformer for bi-directional communication.

FIG. 21A shows current and voltage time-dependent curves for a primary and secondary generated by two inverter signals phases-shifted 180 degrees.

Figure 21B:
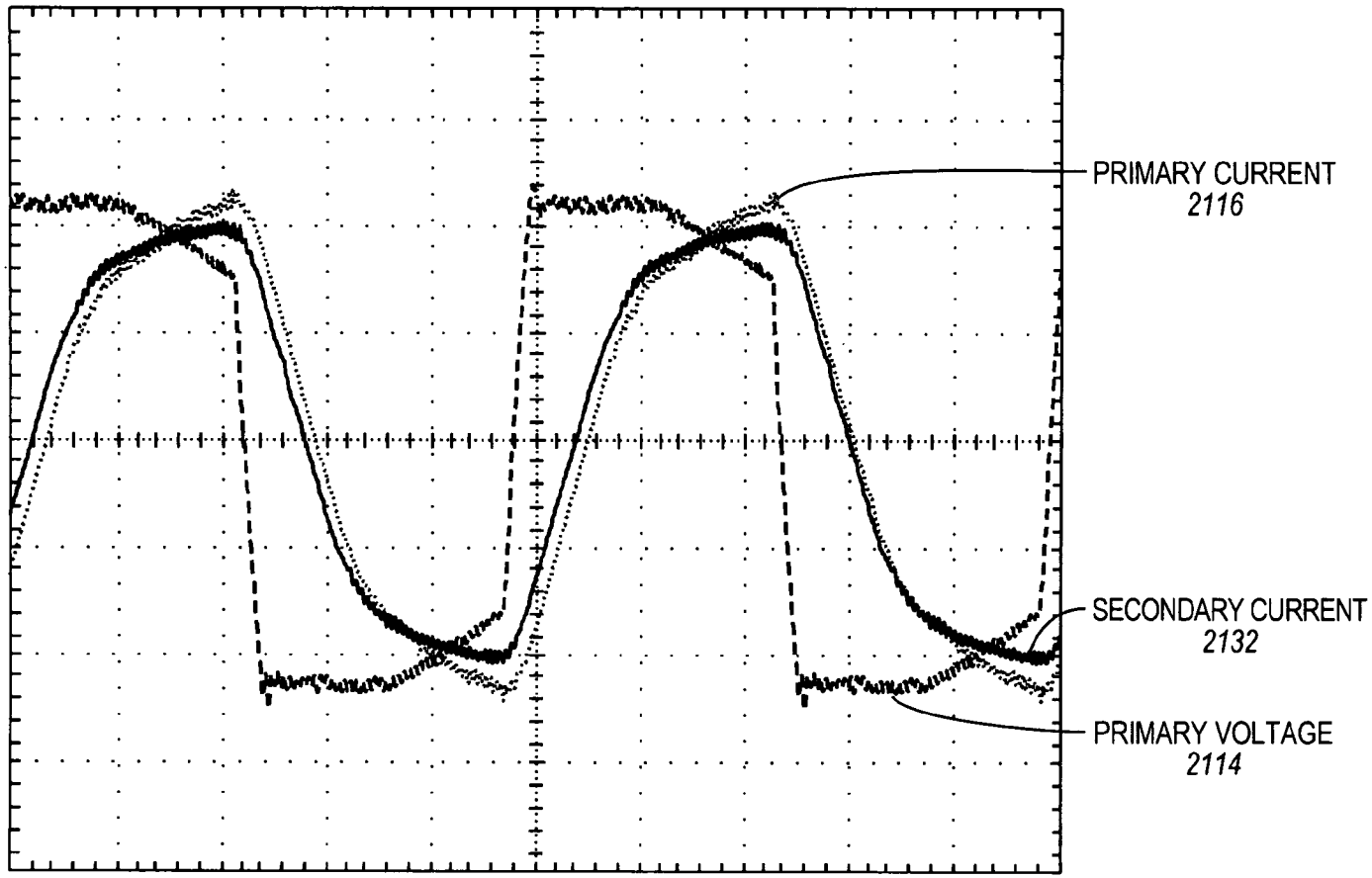
FIGS. 21B, 21C, and 21D shows current and voltage time-dependent curves for a primary and secondary generated by two inverter signals phases-shifted 0 degrees.
Figure 21C:
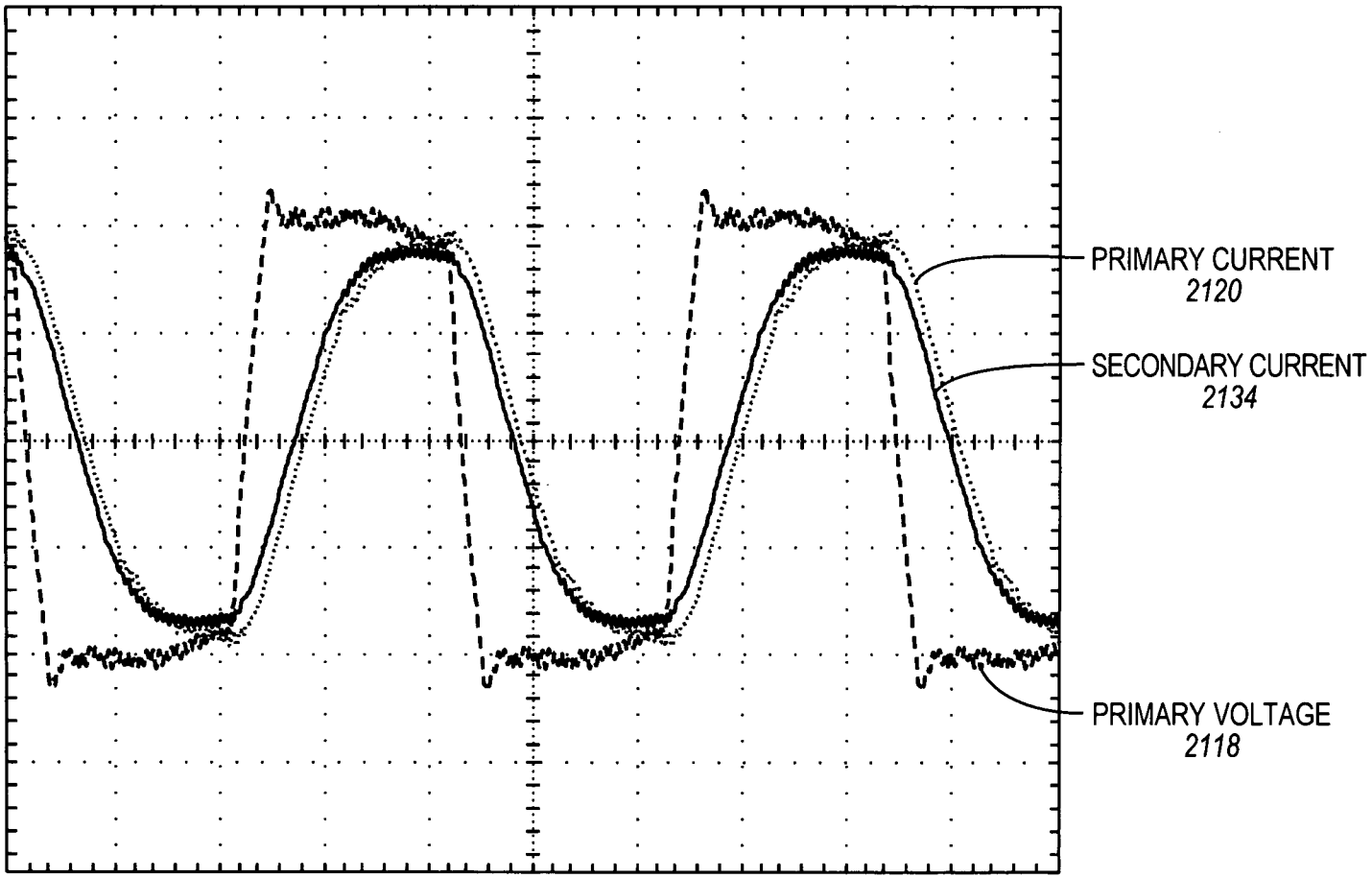
Figure 21D:
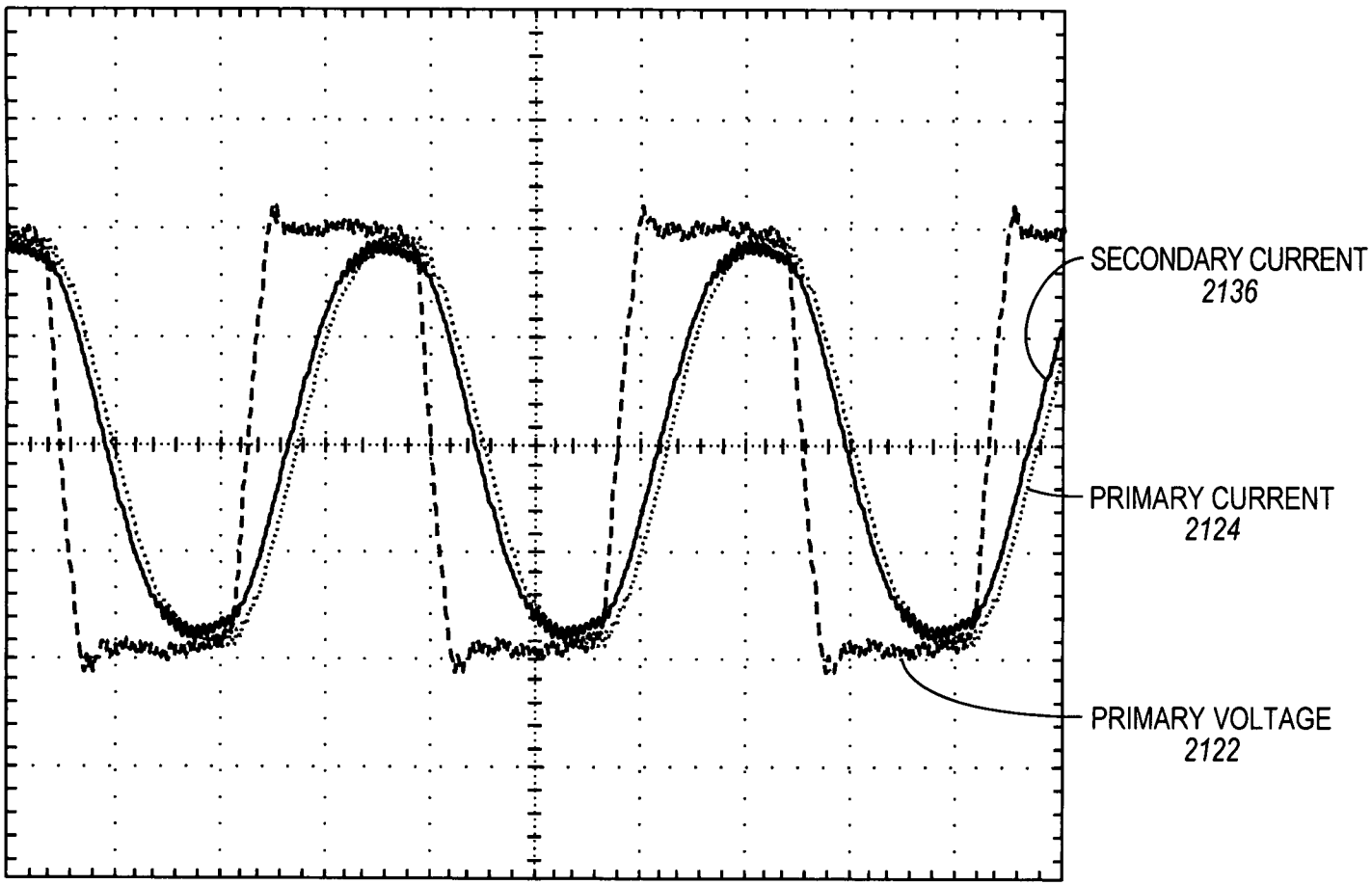

FIGS. 21B, 21C, and 21D shows current and voltage time-dependent curves for a primary and secondary generated by two inverter signals phases-shifted 0 degrees.

While the present invention has been described with reference to the above embodiments and the enclosed drawings, the invention is by no means limited to these embodiments. The present invention also includes any modifications or equivalents within the scope of the following claims.

What is claimed is:

1. A power delivery system for computed tomography, comprising:

a rotary transformer including a stationary winding disposed on a stationary side and a rotating winding disposed on a rotating side;

at least one adaptation isolation transformer coupled to said stationary winding of said rotary transformer, wherein said at least one adaptation isolation transformer is designed to provide power to said stationary winding of said rotary transformer;

at least two power inverters coupled to said adaptation isolation transformer;

a high-voltage unit disposed on said rotating side and connected to receive power transferred to said rotating winding and constructed to provide power used by an X-ray source; and a control unit coupled to said high-voltage unit and said power inverters, said control unit being constructed and cooperatively arranged with said rotary transformer to provide timing signals to said power inverters in a feedback loop arrangement.

2. The power delivery system of claim 1, wherein said stationary winding includes a power stationary winding, and said rotating winding includes a power rotating winding.

3. The power delivery system of claim 1, wherein said adaptation isolation transformer includes an inverter adaptation circuit constructed to receive AC power generated by at least one of said power inverters.

4. The power delivery system of claim 1, wherein said adaptation isolation transformer is constructed to magnetically couple outputs from at least two said power inverters.

5. The power delivery system of claim 1, wherein said stationary winding includes a control stationary winding, and said rotating winding includes a control rotating winding.

6. The power delivery system of claim 5, wherein said control unit includes a stationary controller comprising an adaptation circuit constructed to provide AC signal to said control stationary winding of said rotary transformer.

7. The power delivery system of claim 5, wherein said control unit includes a rotating controller comprising an adaptation circuit constructed to receive AC signals from said control rotating winding.

8. The power delivery system of claim 5, wherein said control unit is constructed to provide said feedback loop arrangement utilizing said control stationary winding and said control rotating winding.

9. A power delivery system for computed tomography, comprising:

a rotary transformer including a stationary winding disposed on a stationary side and a rotating winding disposed on a rotating side;

at least one adaptation isolation transformer coupled to said stationary winding of said rotary transformer, wherein said at least one adaptation isolation transformer is designed to provide power to said stationary winding of said rotary transformer in a multi phase configuration;

at least two power inverters coupled to said adaptation isolation transformer;

a high-voltage unit disposed on said rotating side and connected to receive power transferred to said rotating winding and constructed to provide power used by an X-ray source; and a control unit coupled to said high-voltage unit and said power inverters, said control unit being constructed and cooperatively arranged with said rotary transformer to provide timing signals to said power inverters in a feedback loop arrangement.

10. The power delivery system of claim 9, wherein said stationary winding includes a power stationary winding, and said rotating winding includes a power rotating winding.

11. The power delivery system of claim 9, wherein said adaptation isolation transformer includes an inverter adaptation circuit constructed to receive AC power generated by at least one of said power inverters.

12. The power delivery system of claim 9, wherein said adaptation isolation transformer is constructed to magnetically couple outputs from at least two said power inverters.

13. The power delivery system of claim 9, wherein said stationary winding includes a control stationary winding, and said rotating winding includes a control rotating winding.

14. The power delivery system of claim 13, wherein said control unit includes a stationary controller comprising an adaptation circuit constructed to provide AC signal to said control stationary winding of said rotary transformer.

15. The power delivery system of claim 13, wherein said control unit includes a rotating controller comprising an adaptation circuit constructed to receive AC signals from said control rotating winding.

16. The power delivery system of claim 13, wherein said control unit is constructed to provide said feedback loop arrangement utilizing said control stationary winding and said control rotating winding.

17. A power delivery system for computed tomography, comprising:

a rotary transformer including a stationary winding disposed on a stationary side and a rotating winding disposed on a rotating side;

a first adaptation isolation transformer coupled to said stationary winding of said rotary transformer and a second adaptation isolation transformer coupled to said rotating winding of said rotary transformer wherein said second adaptation isolation transformer includes an adaptation circuit, said second adaptation isolation transformer receiving power from said rotating winding disposed on said rotating side;

at least two power inverters coupled to said first adaptation isolation transformer;

a high-voltage unit disposed on said rotating side and connected to receive power transferred to said rotating winding and constructed to provide power used by an X-ray source; and a control unit coupled to said high-voltage unit and said power inverters, said control unit being constructed and cooperatively arranged with said rotary transformer to provide timing signals to said power inverters in a feedback loop arrangement.

18. The power delivery system of claim 17, wherein said stationary winding includes a control stationary winding, and said rotating winding includes a control rotating winding.

19. The power delivery system of claim 18, wherein said control unit comprises a stationary controller adaptation circuit constructed to receive AC signals from a stationary controller and provide AC signal to said control stationary winding of said rotary transformer.

20. The power delivery system of claim 19, wherein said stationary controller adaptation circuit includes an adaptation coil.

21. The power delivery system of claim 18, wherein said control unit comprises a rotating controller coupled to a rotating controller adaptation circuit constructed to receive AC signals from said control rotating winding.

22. A device for isolating output of power inverters from a rotary transformer adapted to couple power between a stationary winding disposed on a stationary side and a rotational winding disposed on a rotating side of said rotary transformer, the device comprising: an isolation transformer constructed and arranged to receive power generated by power inverters, wherein said isolation transformer constructed to magnetically couple outputs from at least two power inverters and to drive a stationary winding disposed on a stationary side of a rotary transformer.

23. The device of claim 22, wherein said isolation transformer includes an inverter adaptation circuit constructed to receive AC power generated by at least one of said power inverters.

24. The device of claim 22, wherein said stationary winding includes a power stationary winding, and said rotating winding includes a power rotating winding.

25. The device of claim 22, wherein said stationary winding includes a control stationary winding, and said rotating winding includes a control rotating winding.

* * * * *